US010202914B2

(12) United States Patent
Dudar

(10) Patent No.: US 10,202,914 B2
(45) Date of Patent: Feb. 12, 2019

(54) METHOD TO DETERMINE CANISTER LOAD

(71) Applicant: Ford Global Technologies, LLC, Dearborn, MI (US)

(72) Inventor: Aed M. Dudar, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 410 days.

(21) Appl. No.: 14/842,504

(22) Filed: Sep. 1, 2015

(65) Prior Publication Data

US 2017/0058800 A1 Mar. 2, 2017

(51) Int. Cl.

*F02D 41/00* (2006.01)
*F02M 25/08* (2006.01)
*F02D 41/04* (2006.01)

(52) U.S. Cl.

CPC ..... *F02D 41/0045* (2013.01); *F02M 25/0836* (2013.01); *F02M 25/0854* (2013.01); *F02D 41/042* (2013.01); *F02M 25/089* (2013.01)

(58) Field of Classification Search

CPC ..... F02M 25/0809; F02M 25/0818; F02M 25/0827; F02M 25/0836; F02M 25/0854; F02M 25/0872; F02M 25/089; F02M 2025/0845; F02D 41/0045

USPC ..... 123/516, 518–520

See application file for complete search history.

(56) References Cited

U.S. PATENT DOCUMENTS 5,139,001 A * 8/1992 Tada ..... B60K 15/03504 123/494
5,386,812 A * 2/1995 Curran ..... F02M 25/0809 123/520
5,957,113 A 9/1999 Masaki et al.
6,378,505 B1 * 4/2002 Doering ..... F02M 25/0809 123/198 D
6,382,191 B1 * 5/2002 Curran ..... F02D 41/004 123/518
6,422,214 B1 * 7/2002 Sealy ..... F02D 41/0045 123/520
7,233,845 B2 6/2007 Veinotte
8,181,631 B2 5/2012 Bohr et al.
2006/0031000 A1 * 2/2006 Amano ..... F02D 41/0045 701/114

(Continued)

FOREIGN PATENT DOCUMENTS

KR 20080018428 A * 2/2008

OTHER PUBLICATIONS

Anonymous, "A Carbon Canister With Internal Hydrocarbon Sensors to Measure Loading," IPCOM No. 000240421, Published Jan. 29, 2015, 2 pages.

(Continued)

*Primary Examiner* — John Zaleskas
(74) *Attorney, Agent, or Firm* — Julia Voutyras; McCoy Russell LLP

(57) ABSTRACT

Methods and systems are provided for determining a load of a canister included in an evaporative emissions system of a vehicle. One example method comprises flowing each of purge vapors, refueling vapors, and breakthrough vapors through a common hydrocarbon sensor and using output from the hydrocarbon sensor based on the flowing of different vapors to estimate the load of the canister.

19 Claims, 9 Drawing Sheets

(56) References Cited

U.S. PATENT DOCUMENTS

2006/0144373 A1* 7/2006 Kano ..... F02D 41/0045 123/519
2006/0225713 A1* 10/2006 Kano ..... F02D 41/0032 123/520
2007/0062495 A1* 3/2007 Kano ..... F02D 41/0045 123/520
2007/0119423 A1* 5/2007 Kano ..... F02D 41/0045 123/459
2007/0137622 A1* 6/2007 Koyama ..... F02D 41/0045 123/520
2007/0157907 A1* 7/2007 Takakura ..... F02D 41/0045 123/494
2007/0157908 A1* 7/2007 Kano ..... F02M 25/08 123/520
2007/0181103 A1* 8/2007 Okuda ..... F02M 25/0836 123/520
2007/0186915 A1* 8/2007 Annoura ..... F02D 41/0042 123/698
2007/0199548 A1* 8/2007 Maegawa ..... F02M 25/0809 123/520
2007/0246025 A1* 10/2007 Sato ..... F02D 41/0045 123/520
2007/0251509 A1* 11/2007 Nakano ..... F02D 41/0045 123/519
2007/0295313 A1* 12/2007 Amano ..... F02D 41/0032 123/520
2008/0092858 A1* 4/2008 Satoh ..... F02M 25/0809 123/520
2009/0070001 A1* 3/2009 Takakura ..... F02D 41/0032 701/102
2010/0059022 A1* 3/2010 Bierl ..... F02D 41/0032 123/478
2011/0100210 A1 5/2011 Streib et al.
2011/0137540 A1* 6/2011 Mai ..... F02D 41/004 701/103
2011/0168139 A1* 7/2011 Knittel ..... F02D 41/0045 123/518
2012/0168454 A1 7/2012 Hagen
2012/0227580 A1* 9/2012 Dudar ..... F02M 25/0818 95/19
2014/0123961 A1 5/2014 Kragh et al.
2015/0142293 A1 5/2015 Dudar et al.
2015/0345414 A1* 12/2015 Klotz ..... F02D 41/0032 123/520
2015/0354478 A1* 12/2015 Dudar ..... F02D 41/003 123/519
2016/0084175 A1* 3/2016 Dudar ..... F02M 25/0818 123/521
2016/0265456 A1* 9/2016 Dudar ..... F02D 41/004

OTHER PUBLICATIONS

Thompson, Scott J. et al., "Methods and System for Starting an Engine of a Hybrid Vehicle," U.S. Appl. No. 14/448,917, filed Jul. 31, 2014, 28 pages.

* cited by examiner

500

| 3-WAY VALVE POSITION | FUNCTION | MODE | HC SENSOR STATUS | VAPOR DESTINATION |
|---|---|---|---|---|
| 1 | Coupling purge port of canister to HC sensor | Canister purging mode | Receives desorbed purge fuel vapors from canister | Engine intake manifold |
| 2 | Coupling load port of canister to HC sensor | Refueling mode | Receives one or more of refueling vapors, diurnal vapors, running loss vapors, and de-pressurization vapors from fuel tank | Canister |
| 3 | Coupling vent port of canister to HC sensor | One of engine-off vehicle operation, vehicle park, vehicle soak modes | Receives breakthrough fuel vapors from canister | Atmosphere |

FIG. 5

METHOD TO DETERMINE CANISTER LOAD

FIELD

The present description relates generally to estimating a load of a fuel vapor canister included in an emission control system of a vehicle.

BACKGROUND/SUMMARY

Vehicle emission control systems may be configured to store fuel vapors from fuel tank refueling and diurnal engine operations in a fuel vapor canister, and then purge the stored vapors during a subsequent engine operation. The fuel vapors may be stored in the fuel vapor canister, which contains adsorbent material, such as activated carbon, capable of adsorbing hydrocarbon (HC) fuel vapor. A concentration of stored vapors in the fuel vapor canister may be assessed, e.g., as a load of the fuel vapor canister, based on purging and refueling events. If the fuel vapor canister is not purged periodically, stored fuel vapors may break through and reduce emissions compliance of the vehicle.

One example approach to determining the load of the fuel vapor canister includes utilizing output from exhaust gas sensors. Specifically, output from exhaust gas sensors is monitored when the fuel vapor canister is purged and stored vapors are combusted in the engine. Another example approach includes determining canister loading based on temperature changes within the fuel vapor canister during loading and purging. For example, as fuel vapors flow into the fuel vapor canister for storage, canister temperature increases. Further, when the fuel vapor canister is purged, canister temperature decreases. These changes in canister temperature may be monitored to determine the load of the fuel vapor canister.

The inventors herein have recognized potential issues with the above described approaches. For example, in the approach utilizing output from exhaust gas sensors, the engine has to be operational and combusting purged fuel vapors for determining canister load. However, in hybrid vehicles, the engine may be shut down and may not be operated for substantially long durations. Accordingly, learning an existing load of the fuel vapor canister at a given time may not be feasible without engine operation. If the engine has to be activated to learn the existing load of the fuel vapor canister, fuel economy of the hybrid vehicle is reduced. In the example of using canister temperature to estimate the existing load of the fuel vapor canister, the increase in canister temperature in response to adsorbing fuel vapors may be temporary. As an example, if the vehicle is fueled and parked for a considerable duration, the canister temperature may equalize with ambient temperature even though fuel vapors are stored within the fuel vapor canister. Likewise, canister temperature may decrease in response to a purging operation, but this decrease in canister temperature may fade over time. Accordingly, the canister temperature may be used as an indicator of canister load either during active purging with engine operation or during storing of fuel vapors but not when the engine is non-operational.

The inventors herein have recognized the above issues and have developed approaches to at least partially address these issues. One example approach includes a method for an evaporative emissions system in a vehicle, comprising routing each of a purge flow from a fuel vapor canister, a loading flow into the fuel vapor canister, and a breakthrough flow from the fuel vapor canister through a hydrocarbon sensor, and determining a load of the fuel vapor canister based on output from the hydrocarbon sensor during each of the routings. In this way, the existing load of the fuel vapor canister may be estimated without engine operation.

In another example, a method may comprise adjusting a three-way valve to a first position to flow purge vapors from a canister through a hydrocarbon sensor, adjusting the three-way valve to a second position to flow refueling vapors from a fuel tank into the canister via the hydrocarbon sensor, adjusting the three-way valve to a third position to flow breakthrough vapors from the canister into atmosphere via the hydrocarbon sensor, and determining a load of the canister based on output from the hydrocarbon sensor during each adjusting of the three-way valve. Thus, adsorption of fuel vapors and desorption of fuel vapors from the fuel vapor canister may be utilized to estimate the load of the fuel vapor canister.

As one example, a vehicle may include an engine, a fuel system including a fuel tank, and an evaporative emissions control system including a fuel vapor canister and a hydrocarbon (HC) sensor. A three-way valve may be coupled to each of the fuel tank, the fuel vapor canister, and the hydrocarbon sensor. Further, the three-way valve may be capable of assuming one of multiple positions (e.g., three). During a purging operation, for example, the three-way valve may be placed in a first position that allows purged vapors exiting the fuel vapor canister to flow past the HC sensor before entering an intake manifold of the engine for combustion. During a refueling event, the three-way valve may be adjusted to a second position to enable the flow of fuel vapors released from the fuel tank into the fuel vapor canister. Further, fuel vapors exiting the fuel tank may be routed past the HC sensor before entering the fuel vapor canister. During an engine-off mode, such as when the vehicle is parked and no refueling event is occurring, the three-way valve may be adjusted to a third position wherein if fuel vapors breakthrough from the fuel vapor canister, these breakthrough vapors are routed through the HC sensor before escaping into the atmosphere. As such, the HC sensor measures an amount of fuel vapors flowing past during each of the purging operation, the refueling event, and vapor breakthrough conditions. The existing load of the fuel vapor canister may be determined based on the amounts of fuel vapors sensed by the HC sensor during each of the purging operation, the refueling event, and vapor breakthrough conditions.

In this way, an existing load of the fuel vapor canister may be estimated. A single common HC sensor may be used to measure each of a quantity of fuel vapors entering the fuel vapor canister and a quantity of fuel vapors exiting the fuel vapor canister during distinct engine conditions. The technical effect of using HC sensor output is that the load of the fuel vapor canister may be estimated in a more accurate manner. Further, by using a single, common HC sensor, a reduction in hardware components as well as expenses may be obtained. Further still, the load of the fuel vapor canister may be assessed without activating engine combustion for purging. Thus, fuel vapor canister load may be calculated without adverse effects on fuel economy and efficiency of the vehicle.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

FIG. 5 presents a table detailing the various states of the three-way valve and corresponding vapor flow.

DETAILED DESCRIPTION

Figure 1:
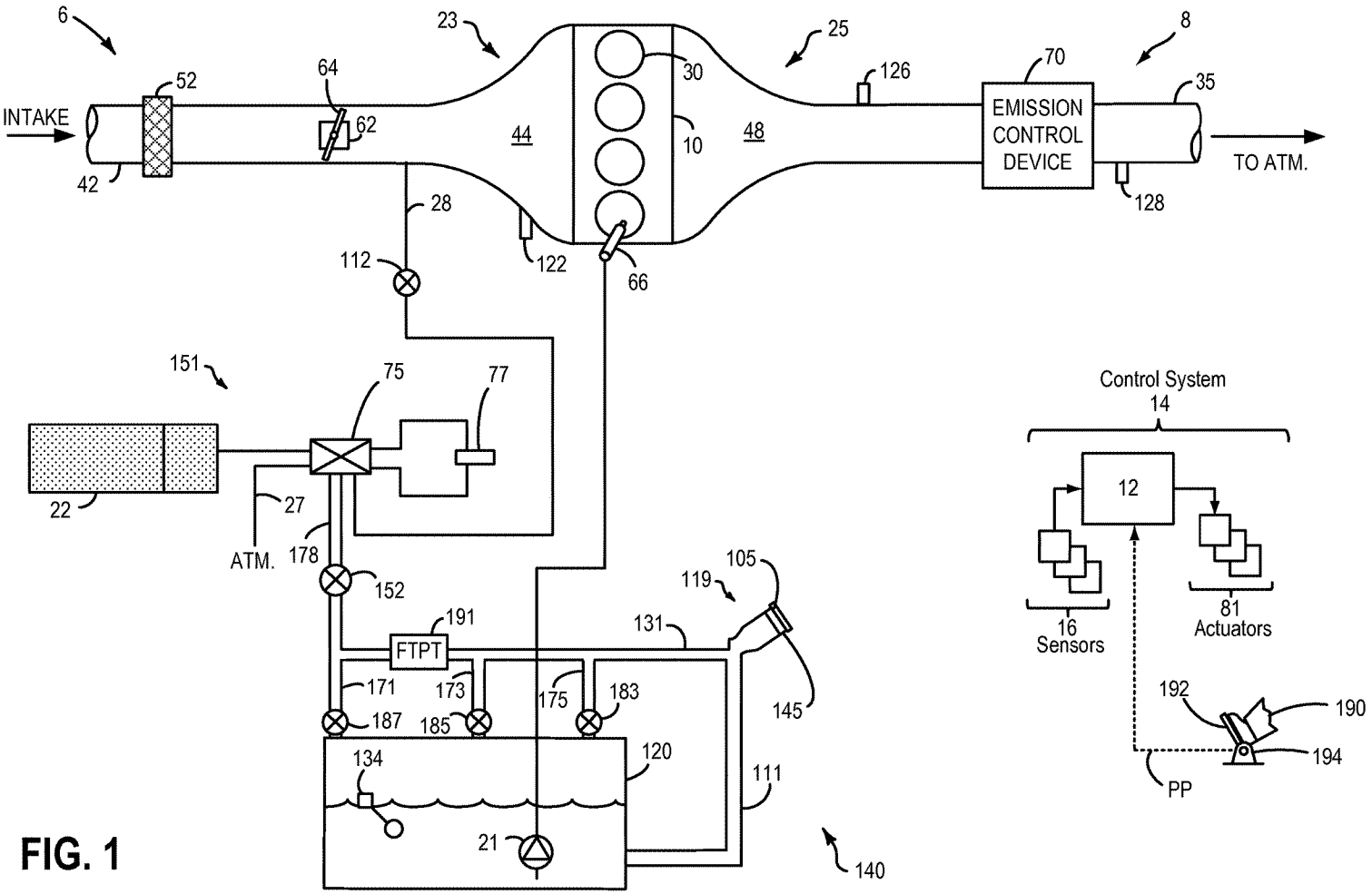
FIG. 1 schematically depicts an example vehicle system with a fuel system and an evaporative emissions system.
Figure 2:
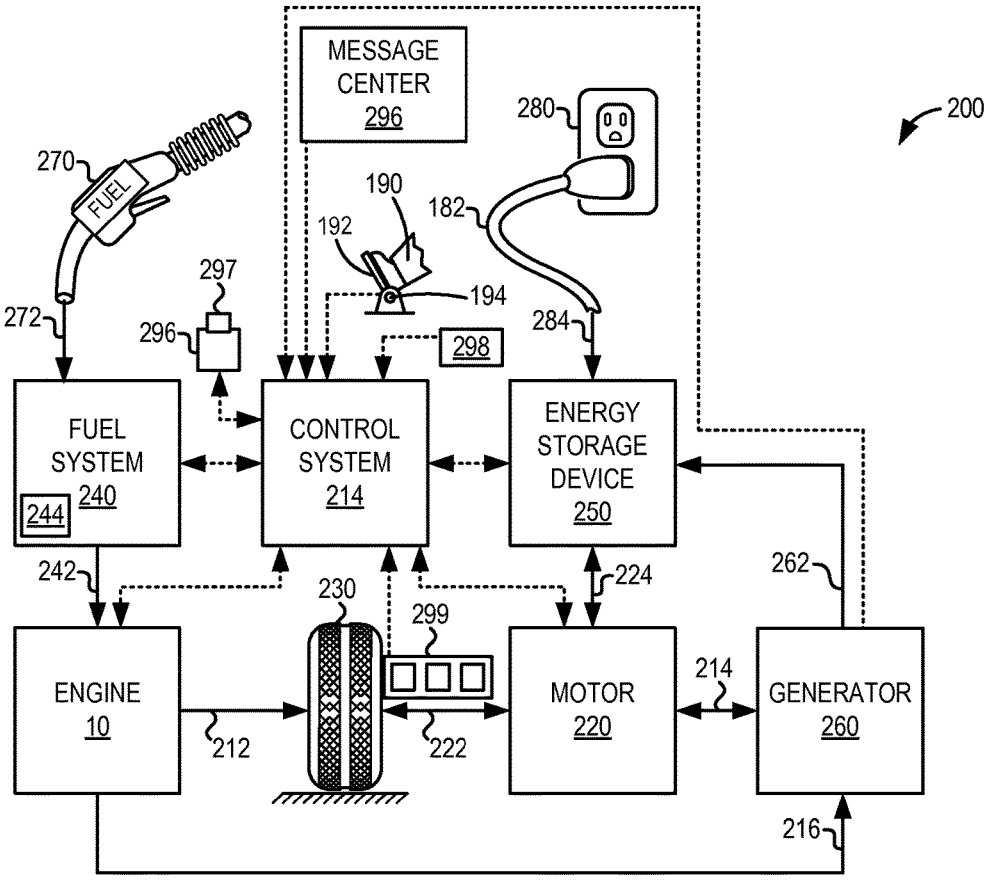
FIG. 2 schematically shows an example vehicle propulsion system.

The following description relates to systems and methods for estimating a load of a fuel vapor canister included in an evaporative emissions system of an engine, such as the example engine shown in FIG. 1. The engine may be coupled within a vehicle. In one example, the vehicle may be a hybrid vehicle (FIG. 2). The evaporative emissions system may also include a three-way valve (FIG. 3) and a hydrocarbon (HC) sensor wherein the HC sensor is capable of measuring an amount of HC fuel vapors flowing therethrough. The three-way valve may assume one of three positions (FIGS. 4A, 4B, and 4C) to enable the flow of one of purge vapors from the fuel vapor canister, HC fuel vapors from a fuel tank, and breakthrough fuel vapors from the fuel vapor canister through the HC sensor (FIG. 5). Specifically, a controller coupled in the vehicle may be configured to perform a routine such as that shown in FIGS. 6A and 6B to adjust the position of the three-way valve based on existing engine and vehicle conditions. The controller may also be configured to perform the routine in FIG. 7 to estimate the existing load of the fuel vapor canister based on output from the HC sensor and initiate a purging operation in response to the existing canister load being higher than a threshold. FIG. 8 depicts example changes to the position of the three-way valve. Thus, the canister may be emptied and regenerated regularly.

FIG. 1 shows a schematic depiction of a vehicle system 6. The vehicle system 6 includes an engine system 8 coupled to an emissions control system 151 (also termed, an evaporative emissions system) and a fuel system 140. Emission control system 151 includes a fuel vapor container or canister 22 which may be used to capture and store fuel vapors. In some examples, vehicle system 6 may be a hybrid electric vehicle system.

The engine system 8 may include an engine 10 having a plurality of cylinders 30. Engine 10 may be controlled at least partially by a control system 14 including a controller 12 and by input from a vehicle operator 190 via an input device 192. In this example, input device 192 includes an accelerator pedal and a pedal position sensor 194 for generating a proportional pedal position signal PP.

Engine 10 includes an engine intake 23 and an engine exhaust 25. The engine intake 23 includes a throttle 62 coupled within intake manifold 44 to an intake passage 42. Fresh intake air enters the intake passage 42 and flows through air filter 52 before streaming past throttle 62 (also termed intake throttle 62). Throttle 62 includes a throttle plate 64, and in the depicted example a position of the intake throttle 62 (specifically, a position of the throttle plate 64) may be varied by controller 12 of control system 14 via a signal provided to an electric motor or actuator included with intake throttle 62, a configuration that is commonly referred to as electronic throttle control (ETC). In this manner, throttle 62 may be operated to vary an amount of intake air provided to intake manifold 44 and the plurality of cylinders therein.

The engine exhaust 25 includes an exhaust manifold 48 leading to an exhaust passage 35 that routes exhaust gas to the atmosphere. The engine exhaust 25 may include one or more emission control devices 70 (also termed emissions catalyst), which may be mounted in a close-coupled position in the exhaust. One or more emission control devices may include a three-way catalyst, lean NOx trap, diesel particulate filter, oxidation catalyst, etc. It will be appreciated that other components may be included in the engine such as a variety of valves and sensors.

Fuel system 140 may include a fuel tank 120 coupled to a fuel pump system 21. The fuel pump system 21 may include one or more pumps for pressurizing fuel delivered to the injectors of engine 10, such as the example injector 66 shown. While only a single injector 66 is shown, additional injectors are provided for each of the plurality of cylinders 30. It will be appreciated that fuel system 140 may be a return-less fuel system, a return fuel system, or various other types of fuel system. Fuel tank 120 may hold a plurality of fuel blends, including fuel with a range of alcohol concentrations, such as various gasoline-ethanol blends, including E10, E85, gasoline, etc., and combinations thereof. A fuel level sensor 134 located in fuel tank 120 may provide an indication of the fuel level ("Fuel Level Input") to controller 12. As depicted, fuel level sensor 134 may comprise a float connected to a variable resistor. Alternatively, other types of fuel level sensors may be used.

Vapors generated in fuel system 140 may be routed to evaporative emissions control system 151, specifically to fuel vapor canister 22 via vapor recovery line 131, before being purged to the engine intake 23. Fuel vapor canister 22 may also be termed fuel system canister or simply, canister 22 herein. Vapor recovery line 131 may be coupled to fuel tank 120 via one or more conduits and may include one or more valves for isolating the fuel tank during certain conditions. For example, vapor recovery line 131 may be coupled to fuel tank 120 via one or more or a combination of conduits 171, 173, and 175.

Further, in some examples, one or more fuel tank vent valves may be included in conduits 171, 173, or 175. Among other functions, fuel tank vent valves may allow a fuel vapor canister of the emissions control system to be maintained at a low pressure or vacuum without increasing the fuel evaporation rate from the tank (which would otherwise occur if the fuel tank pressure were lowered). For example, conduit 171 may include a grade vent valve (GVV) 187, conduit 173 may include a fill limit venting valve (FLVV) 185, and conduit 175 may include a grade vent valve (GVV) 183. Further, in some examples, recovery line 131 may be coupled to a fuel filler system 119. In some examples, fuel filler system 119 may include a fuel cap 105 for sealing off the fuel filler system from the atmosphere. Fuel filler system 119 may also be termed refueling system 119. Refueling system 119 is coupled to fuel tank 120 via a fuel filler pipe or neck 111.

Further, refueling system 119 may include refueling lock 145. In some embodiments, refueling lock 145 may be a fuel cap locking mechanism. The fuel cap locking mechanism may be configured to automatically lock the fuel cap in a closed position so that the fuel cap cannot be opened. For example, the fuel cap 105 may remain locked via refueling lock 145 while pressure or vacuum in the fuel tank is greater than a threshold. In response to a refuel request, e.g., a vehicle operator initiated request, the fuel tank may be depressurized and the fuel cap unlocked after the pressure or vacuum in the fuel tank falls below a threshold. A fuel cap locking mechanism may be a latch or clutch, which, when engaged, prevents the removal of the fuel cap. The latch or clutch may be electrically locked, for example, by a solenoid, or may be mechanically locked, for example, by a pressure diaphragm.

In some embodiments, refueling lock 145 may be a filler pipe valve located at a mouth of fuel filler pipe 111. In such embodiments, refueling lock 145 may not prevent the removal of fuel cap 105. Rather, refueling lock 145 may prevent the insertion of a refueling pump into fuel filler pipe 111. The filler pipe valve may be electrically locked, for example by a solenoid, or mechanically locked, for example by a pressure diaphragm.

In some embodiments, refueling lock 145 may be a refueling door lock, such as a latch or a clutch which locks a refueling door located in a body panel of the vehicle. The refueling door lock may be electrically locked, for example by a solenoid, or mechanically locked, for example by a pressure diaphragm.

In embodiments where refueling lock 145 is locked using an electrical mechanism, refueling lock 145 may be unlocked by commands from controller 12, for example, when a fuel tank pressure decreases below a pressure threshold. In embodiments where refueling lock 145 is locked using a mechanical mechanism, refueling lock 145 may be unlocked via a pressure gradient, for example, when a fuel tank pressure decreases to atmospheric pressure.

Fuel vapor canister 22 in evaporative emissions control system 151 may be filled with an appropriate adsorbent to temporarily trap fuel vapors (including vaporized hydrocarbons). In one example, the adsorbent used is activated charcoal. Fuel system canisters in non-hybrid vehicles may receive refueling vapors generated during fuel tank refilling operation, diurnal vapors generated during daily changes in ambient temperature, as well as "running loss" vapors (that is, fuel vaporized during vehicle operation). However, in hybrid vehicles, the fuel system canister may only receive refueling vapors and diurnal vapors, as running loss vapors may be blocked from entering the canister during vehicle operation.

Thus, fuel vapors may be accumulated in fuel vapor canister until they can be purged. If a purging operation does not occur, such as during operation of a hybrid vehicle in an engine-off mode (e.g., with a motor propelling the hybrid vehicle), a concentration of stored fuel vapors in the fuel vapor canister may increase. As such, if the fuel vapor canister is not purged, hydrocarbons stored in the canister may slip into the atmosphere, degrading emissions and making the vehicle emissions non-compliant. Accordingly, the canister may be monitored constantly for evaluating a current load of the canister.

In the present disclosure, the inventors employ a single hydrocarbon sensor and a three-way valve that routes fuel vapors past the hydrocarbon sensor during any event that causes a change in a loading state of the canister (e.g., refueling mode, purging mode, breakthrough conditions). Further, the hydrocarbon sensor estimates an amount of fuel vapors flowing past during each event. This estimate of the amount of fuel vapors may be utilized to determine the loading state of the fuel system canister as will be further detailed in reference to FIGS. 6A, 6B, and 7.

Accordingly, as shown in FIG. 1, emissions control system 151 may include a three-way valve 75, which is a multi-position valve that either enables or blocks fluidic communication between various components in the fuel system and evaporative emissions control system 151. As shown, the three-way valve 75 is coupled to each of fuel tank 120, fuel vapor canister 22, canister purge valve 112, vent line 27, and hydrocarbon sensor 77 (or HC sensor 77).

During a refueling event when the load of the canister 22 can change (e.g. increase), the three-way valve routes fuel vapors from the fuel tank 120 (e.g., diurnal vapors, refueling vapors) past the HC sensor 77 before guiding these fuel vapors to the canister 22 for storage. Vapor blocking valve (VBV) 152 or fuel tank isolation valve (FTIV) 152 may be positioned in conduit 178 between the fuel tank 120 and three-way valve 75. As such, in one example, FTIVs may be included in plug-in hybrid electric vehicles (PHEV) while VBVs are included in hybrid vehicles, vehicles with start-stop systems, etc.

VBV 152 (or FTIV 152) may be a normally closed valve, that when opened, allows for the venting of fuel vapors from fuel tank 120 to canister 22 for adsorption (via three-way valve 75). Meanwhile, vent line 27 or canister ventilation path 27 may route air stripped of fuel vapors out of canister 22 to the atmosphere when storing, or trapping, fuel vapors from fuel system 140. Three-way valve 75, positioned between canister 22 and vent line 27, may provide fluidic communication between canister 22 and vent line 27 to enable the flow of air from canister 22 to atmosphere.

During a purging event when the load of the canister reduces, the three-way valve 75 routes purged vapors from the fuel system canister 22 through the HC sensor 77 before directing these purged vapors into purge line 28 and through canister purge valve 112 into intake manifold 44. Fresh air may be drawn into vent line 27 and through three-way valve 75 to desorb vapors from canister 22 during the purging event. For example, canister purge valve 112 may be normally closed but may be opened during certain conditions (e.g., purging) so that vacuum from engine intake manifold 44 is provided to the fuel vapor canister for purging. Fuel vapors stored in canister 22 may be desorbed by fresh air entering the canister from vent line 27. These desorbed fuel vapors may then be purged from the canister through the three-way valve 75, past HC sensor 77, and through canister purge valve 112 via purge line 28.

When the vehicle is parked (without engine combustion), or when the hybrid vehicle is propelled primarily by a motor (e.g., engine-off mode), fuel vapors collected in the canister may bleed into the atmosphere via the vent line if the canister has a leak, or if the canister is storing a higher amount of vapors. Herein, the three-way valve may route breakthrough vapors from the canister past the HC sensor before the breakthrough vapors are released into the vent line and thereon into atmosphere. Further details of the three-way valve will be described in reference to FIGS. 3 and 4.

Controller 12 may be included in control system 14. Control system 14 is shown receiving information from a plurality of sensors 16 (various examples of which are described herein) and sending control signals to a plurality of actuators 81 (various examples of which are described herein). As one example, sensors 16 may include HC sensor 77, exhaust gas sensor 126 located upstream of the emission control device 70, temperature sensor 128, manifold pressure sensor 122, and fuel tank pressure sensor 191. Other sensors than those described above may be coupled to various locations in the vehicle system 6. As another example, the actuators 81 may include three-way valve 75, canister purge valve 112, fuel injector 66, throttle 62, VBV or fuel tank isolation valve 152, and refueling lock 145. The control system 14 may include controller 12. The controller may receive input data from the various sensors, process the input data, and trigger the actuators in response to the processed input data based on instruction or code programmed therein corresponding to one or more routines. An example control routine is described herein with regard to FIGS. 6A, 6B, and 7. The controller may employ various actuators (such as those described above) to adjust engine operation, and vehicle operation based on signals received from the various sensors and instructions stored on a memory of the controller. For example, adjusting an opening of VBV 152 may include adjusting an actuator (e.g., a solenoid) of the VBV to either increase an opening or decrease an opening of the VBV.

It will be noted that controller 12 may also be referred to as a powertrain control module or PCM.

Turning now to FIG. 2, illustrates an example vehicle propulsion system 200. Vehicle propulsion system 200 includes a fuel burning engine, such as engine 10 of FIG. 1, and a motor 220. As a non-limiting example, engine 10 comprises an internal combustion engine and motor 220 comprises an electric motor. Motor 220 may be configured to utilize or consume a different energy source than engine 10. For example, engine 10 may consume a liquid fuel (e.g., gasoline) to produce an engine output while motor 220 may consume electrical energy to produce a motor output. As such, a vehicle with propulsion system 200 may be referred to as a hybrid electric vehicle (HEV).

Vehicle propulsion system 200 may utilize a variety of different operational modes depending on operating conditions encountered by the vehicle propulsion system. Some of these modes may enable engine 10 to be maintained in an off state (i.e. set to a deactivated state) where combustion of fuel at the engine is discontinued. For example, under select operating conditions, motor 220 may propel the vehicle via drive wheel 230 as indicated by arrow 222 while engine 10 is deactivated.

During other operating conditions, engine 10 may be set to a deactivated state (as described above) while motor 220 may be operated to charge energy storage device 250. For example, motor 220 may receive wheel torque from drive wheel 230 as indicated by arrow 222 where the motor may convert the kinetic energy of the vehicle to electrical energy for storage at energy storage device 250 as indicated by arrow 224. This operation may be referred to as regenerative braking of the vehicle. Thus, motor 220 can provide a generator function in some embodiments. However, in other embodiments, generator 260 may instead receive wheel torque from drive wheel 230, where the generator may convert the kinetic energy of the vehicle to electrical energy for storage at energy storage device 250 as indicated by arrow 262.

During still other operating conditions, engine 10 may be operated by combusting fuel received from fuel system 140 (which may be the same as the fuel system in FIG. 1) as indicated by arrow 242. For example, engine 110 may be operated to propel the vehicle via drive wheel 230 as indicated by arrow 212 while motor 220 is deactivated. During other operating conditions, both engine 10 and motor 220 may each be operated to propel the vehicle via drive wheel 230 as indicated by arrows 212 and 222, respectively. A configuration where both the engine and the motor may selectively propel the vehicle may be referred to as a parallel type vehicle propulsion system. Note that in some embodiments, motor 220 may propel the vehicle via a first set of drive wheels and engine 10 may propel the vehicle via a second set of drive wheels.

In other embodiments, vehicle propulsion system 200 may be configured as a series type vehicle propulsion system, whereby the engine does not directly propel the drive wheels. Rather, engine 10 may be operated to power motor 220, which may in turn propel the vehicle via drive wheel 230 as indicated by arrow 222. For example, during select operating conditions, engine 10 may drive generator 260, which may in turn supply electrical energy to one or more of motor 220 as indicated by arrow 214 or energy storage device 250 as indicated by arrow 262. As another example, engine 10 may be operated to drive motor 220 which may in turn provide a generator function to convert the engine output to electrical energy, where the electrical energy may be stored at energy storage device 250 for later use by the motor.

Fuel system 240 (e.g., may be the same as fuel system 140 of FIG. 1) may include one or more fuel storage tanks 244 for storing fuel on-board the vehicle. For example, fuel tank 244 (which may be the same as fuel tank 120 in FIG. 1) may store one or more liquid fuels, including but not limited to: gasoline, diesel, and alcohol fuels. In some examples, the fuel may be stored on-board the vehicle as a blend of two or more different fuels. For example, fuel tank 244 may be configured to store a blend of gasoline and ethanol (e.g., E10, E85, etc.) or a blend of gasoline and methanol (e.g., M10, M85, etc.), whereby these fuels or fuel blends may be delivered to engine 10 as indicated by arrow 242. Still other suitable fuels or fuel blends may be supplied to engine 10, where they may be combusted at the engine to produce an engine output. The engine output may be utilized to propel the vehicle as indicated by arrow 212 or to recharge energy storage device 250 via motor 220 or generator 260.

In some embodiments, energy storage device 250 may be configured to store electrical energy that may be supplied to other electrical loads residing on-board the vehicle (other than the motor), including cabin heating and air conditioning, engine starting, headlights, cabin audio and video systems, etc. As a non-limiting example, energy storage device 250 may include one or more batteries and/or capacitors.

Control system 214 (which may be the same as control system 14 in FIG. 1) may communicate with one or more of engine 10, motor 220, fuel system 240, energy storage device 250, and generator 260. Control system 214 may receive sensory feedback information from one or more of engine 10, motor 220, fuel system 240, energy storage device 250, and generator 260. Further, control system 214 may send control signals to one or more of engine 10, motor 220, fuel system 240, energy storage device 250, and generator 260 responsive to this sensory feedback. Control system 214 may receive an indication of an operator requested output of the vehicle propulsion system from a vehicle operator 190. For example, control system 214 may receive sensory feedback from pedal position sensor 194 which communicates with pedal 192. Pedal 192 may refer schematically to a brake pedal and/or an accelerator pedal.

Energy storage device 250 may periodically receive electrical energy from a power source 280 residing external to the vehicle (e.g., not part of the vehicle) as indicated by arrow 284. As a non-limiting example, vehicle propulsion system 200 may be configured as a plug-in hybrid electric vehicle (HEV), whereby electrical energy may be supplied to energy storage device 250 from power source 280 via an electrical energy transmission cable 282. During a recharging operation of energy storage device 250 from power source 280, electrical transmission cable 282 may electrically couple energy storage device 250 and power source 280. While the vehicle propulsion system is operated to propel the vehicle, electrical transmission cable 282 may be disconnected between power source 280 and energy storage device 250. Control system 214 may identify and/or control the amount of electrical energy stored at the energy storage device, which may be referred to as the state of charge (SOC).

In other embodiments, electrical transmission cable 282 may be omitted, where electrical energy may be received wirelessly at energy storage device 250 from power source 280. For example, energy storage device 250 may receive electrical energy from power source 280 via one or more of electromagnetic induction, radio waves, and electromagnetic resonance. As such, it should be appreciated that any suitable approach may be used for recharging energy storage device 250 from a power source that does not comprise part of the vehicle. In this way, motor 220 may propel the vehicle by utilizing an energy source other than the fuel utilized by engine 10.

Fuel system 240 may periodically receive fuel from a fuel source residing external to the vehicle. As a non-limiting example, vehicle propulsion system 200 may be refueled by receiving fuel via a fuel dispensing device 270 as indicated by arrow 272. In some embodiments, fuel tank 244 may be configured to store the fuel received from fuel dispensing device 270 until it is supplied to engine 10 for combustion. In some embodiments, control system 214 may receive an indication of the level of fuel stored at fuel tank 244 via a fuel level sensor. The level of fuel stored at fuel tank 244 (e.g., as identified by the fuel level sensor) may be communicated to the vehicle operator, for example, via a fuel gauge or indication in a vehicle instrument panel 296.

The vehicle propulsion system 200 may also include an ambient temperature/humidity sensor 298, and a roll stability control sensor, such as a lateral and/or longitudinal and/or yaw rate sensor(s) 299. The vehicle instrument panel 296 may include indicator light(s) and/or a text-based display in which messages are displayed to an operator. The vehicle instrument panel 296 may also include various input portions for receiving an operator input, such as buttons, touch screens, voice input/recognition, etc. For example, the vehicle instrument panel 296 may include a refueling button 297 which may be manually actuated or pressed by a vehicle operator to initiate refueling. For example, as described in more detail below, in response to the vehicle operator actuating refueling button 297, a fuel tank in the vehicle may be depressurized so that refueling may be performed.

In an alternative embodiment, the vehicle instrument panel 296 may communicate audio messages to the operator without display. Further, the sensor(s) 299 may include a vertical accelerometer to indicate road roughness. These devices may be connected to control system 214. In one example, the control system may adjust engine output and/or the wheel brakes to increase vehicle stability in response to sensor(s) 299.

The evaporative emissions system may also be included in vehicle propulsion system 200, though not specifically depicted. As such, the HEV depicted in FIG. 2 may experience reduced durations of engine operation wherein the engine is combusting and propelling the vehicle. Thus, the fuel vapor canister within may not be cleared of stored vapors as frequently as desired which may lead to a more saturated state of the fuel vapor canister and resulting bleed emissions from the fuel vapor canister. Accordingly, a loading state of the fuel vapor canister may be evaluated as will be described below.

Figure 3:
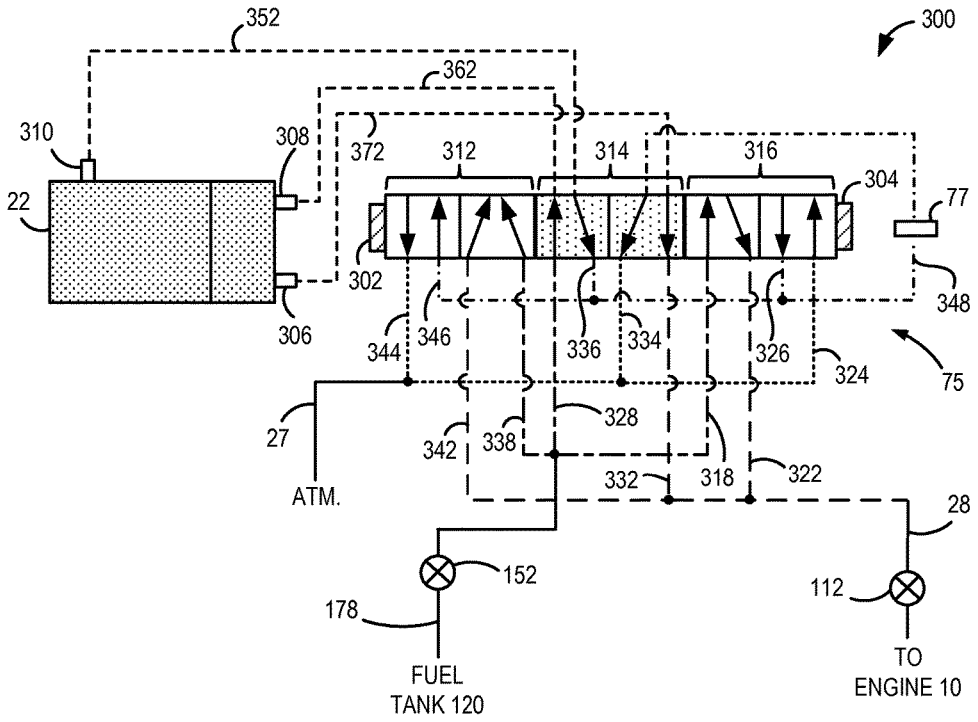
FIG. 3 depicts a schematic view of a three-way valve included in the evaporative emissions system, the three-way valve enabling routing of fuel vapors from a specific origin to a given destination.

FIG. 3 presents a detailed schematic view 300 of three-way valve 75 of FIG. 1 coupled to each of HC sensor 77, fuel tank 120, canister purge valve (CPV) 112, atmosphere via vent line 27, and fuel vapor canister 22. As such, schematic view 300 will be described in relation to the example system shown in FIG. 1. Accordingly components introduced in FIG. 1 are numbered similarly. It should be understood that three-way valves distinct and dissimilar to the one described herein may be used without departing from the scope of this disclosure. Three-way valve 75 may be actuated by a controller, such as controller 12 of FIG. 1, to shift its conformation. Specifically, three-way valve 75 may include a first solenoid 302 and a second solenoid 304 and each of the solenoids may be actuated either separately or together by the controller to change the conformation of three-way valve 75. By adjusting the conformation of three-way valve 75, specific components in the evaporative emissions system and fuel system may be either in fluidic communication or may be blocked from fluidic communication.

Three-way valve 75 includes three segments: a first segment 312, a second segment 314, and a third segment 316, along with first solenoid 302 and the second solenoid 304. As such, the three-way valve 75 comprises each of the first segment, the second segment, and the third segment along with first solenoid 302 and second solenoid 304. The first segment 312 may be utilized during loading flow, the second segment 314 may be utilized during breakthrough flow (e.g., bleed emissions from canister), and the third segment 316 may be utilized during purge flow. Loading flow includes a flow of fuel vapors from the fuel tank into the fuel vapor canister for adsorption thereby increasing the loading state of the fuel vapor canister. It will be noted that segments of the three-way valve that are being utilized in a certain conformation of the three-way valve 75 are depicted as dotted regions in FIGS. 3, 4A, 4B, and 4C.

FIG. 3 also depicts fuel vapor canister 22 including at least three ports: purge port 306, load port 308, and vent port 310. Each of the three ports is coupled to the three-way valve and depending on the conformation of the three-way valve, one of the three ports may experience a flow of vapors therethrough. At the same time, a distinct port may experience a flow of air therethrough. The three ports are depicted coupled to the three-way valve 75 via lines with medium dashes. Specifically, in the depicted position of the three-way valve 75 (with second segment 314 being utilized), the vent port 310 may be coupled to the three-way valve 75 via link 352, load port 308 of canister 22 may be coupled to three-way valve 75 via link 362, and purge port 306 of canister 22 may be coupled to three-way valve 75 in its existing position in FIG. 3 via link 372.

As such, in each position of the three-way valve 75, the three ports of the fuel vapor canister 22 may be coupled to the three-way valve but based on the conformation, only a selected subset of the three ports may experience a flow fuel vapors. For example, during a refueling event, the load port 308 of the fuel vapor canister 22 may receive loading flow (e.g., refuel vapors) from the fuel tank via the three-way valve and the HC sensor. Further, the vent port 310 may expel air that is stripped of fuel vapors into the atmosphere (via the three-way valve) along vent line 27. However, during the refueling event, the purge port 306 may not flow fuel vapors as the CPV 112 is closed. In another example, during a purge operation, the purge port 306 may experience a flow of vapors (e.g., desorbed vapors) from the canister while the load port 308 may not receive fuel vapors. The vent port 310 may, however, receive a flow of fresh air from the atmosphere to enable desorption of stored fuel vapors during the purge event.

Further, as shown in FIG. 3, the fuel tank 120 may be coupled to the three-way valve 75 via conduit 178, and conduit 178 may be fluidically coupled to the three-way valve 75 via three channels 318, 328, and 338, represented as lines with alternating large and small dashes. It will be noted that while at least one of the three channels 318, 328, 338 couples conduit 178 to the three-way valve 75 at a given position of the three-way valve, a state of VBV 152 may determine whether fuel vapors may flow through conduit 178 and one of the three channels 318, 328, 338 into three-way valve 75.

The VBV 152 (or FTIV 152, when present) may be a binary valve (e.g., a two-way valve). Binary valves may be controlled either fully open or fully closed (shut), such that a fully open position of a binary valve is a position in which the valve exerts no flow restriction, and a fully closed position of a binary valve is a position in which the valve restricts all flow such that no flow may pass through the valve. The VBV (or FTIV) may be controlled by an actuator (e.g., electromechanical) that receives signals from a controller, such as controller 12 of FIG. 1, and based on the signals, the actuator either opens or closes the VBV. In alternative embodiments, VBV 152 may be a continuously variable valve, wherein the valve may be partially opened to varying degrees. Herein, the valve may assume a fully closed position, a fully open position, or any position therebetween.

Thus, the flow of fuel vapors from fuel tank 120 along conduit 178 and one of the three channels 318, 328, and 338 may depend on the position of the VBV 152. If the VBV is closed, fuel vapors may not be conducted from the fuel tank into the three-way valve.

Further still, the CPV 112 may be coupled to the three-way valve 75 via purge line 28, and purge line 28 may be fluidically coupled to the three-way valve 75 via three passages 322, 332, and 342, represented as lines with large dashes. It will be noted that while at least one of the three passages 322, 332, and 342 couples purge line 28 (and CPV 112) to the three-way valve 75 at a given position of the three-way valve, a state of CPV 112 may determine whether fuel vapors flow into purge line 28 via three-way valve 75. For example, when the three-way valve 75 is at the position shown in schematic view 300 and second segment 314 is utilized for fluid flow (dotted region in second segment 314), the purge port 306 of the canister 22 is coupled to second segment 314 via link 372. Further, purge line 28 is also in fluidic communication with three-way valve 75 (and second segment 314) via passage 332. However, there may be no flow of purge vapors through the three-way valve as the CPV 112 may be maintained closed during engine conditions when purging conditions are not met e.g. when the engine is not combusting, refueling event, etc.

It will also be noted that the CPV may be binary valve capable of assuming one of two positions: a fully closed position and a fully open position. As such, the CPV may be a solenoid actuated valve wherein the solenoid within the CPV receives signals from controller 12. The controller may communicate a desired position of the CPV to the solenoid, which then actuates the CPV to its desired position. Other forms of the CPV may be contemplated without departing from the scope of this disclosure.

Furthermore, the three-way valve 75 may be in fluidic communication with the atmosphere via vent line 27. As such, the three-way valve 75 and vent line 27 may be fluidically coupled via three conduits 324, 334, and 344, represented as lines with small dashes (or dotted lines). In a given position of the three-way valve 75, only one of the three conduits 324, 334, and 344 may fluidically couple vent line 27 to three-way valve 75, and may experience fluid flow (e.g., air flow, fuel vapor flow) therethrough. For example, air may flow into the canister 22 via the vent line 27 and the three-way valve 75 (e.g., purge flow), air may exit the canister 22 (e.g., during the loading flow) or fuel vapors may exit the canister 22 (e.g., breakthrough flow) into the atmosphere via each of the three-way valve and the vent line.

In addition to the above, the three-way valve 75 is also fluidically coupled to HC sensor 77 via three paths 326, 336, and 346, and common path 348, represented as alternating dot and dash lines. As such, HC sensor is positioned in common path 348. The three-way valve may be adjusted, such as by activating one of the three segments of the three-way valve 75, based on engine conditions to fluidically couple the HC sensor to at least one of the load port, the vent port, and the purge port of the canister. Thus, the same HC sensor may be coupled to each of the load port, the vent port, and the purge port of the canister at a given position of the three-way valve.

It will be noted that a single HC sensor 77 is included in the example embodiment of engine system 8 of FIG. 1. The inventors herein have recognized that in HEVs and vehicles equipped with start-stop systems, the fuel vapor canister may not adsorb fuel vapors at the same time (e.g., concurrently) as fuel vapors are desorbed. For example, the VBV may be opened in response to a refueling event while the CPV is closed. Further, the VBV may be adjusted closed to block flow of fuel vapors from the fuel tank into the canister during one of a purge operation, engine operation or when a refueling event is not anticipated. For example, in vehicles that are hybrid vehicles or vehicle that include start-stop powertrains, adsorption of fuel vapors in the canister and desorption of fuel vapors from the canister may be mutually exclusive processes. Accordingly, a single, common HC sensor with a three-way routing valve, such as three-way valve 75, may be utilized to measure fuel vapor adsorption, fuel vapor desorption, and HC vapor breakthrough from the canister.

In short, during a refueling event when the VBV is opened and fuel vapors are to be loaded into the canister from the fuel tank, the three-way valve may enable fluidic communication between the load port of the canister, the fuel tank, and the HC sensor. Herein, fuel vapors traveling from the fuel tank may be routed through the HC sensor first before entering the load port of the canister. In another example, during a purge operation (when the CPV is opened and VBV is closed), the three-way valve may enable fluidic communication between the purge port of the canister, the HC sensor, and the purge line. Herein, fuel vapors desorbed from the canister may flow from the purge port to the HC sensor before entering the purge line and the CPV. In yet another example, when the engine is not combusting, e.g., when the vehicle is parked, and breakthrough of HC vapors is possible, the three-way valve may fluidically couple the vent port of the canister, the HC sensor, and the vent line. Herein, fuel vapors bleeding from the canister via the vent port may travel across the HC sensor before exiting the evaporative emissions control system 151 via the vent line. It will be noted that the same HC sensor may receive each of the refueling vapors (and diurnal vapors), purge vapors, and breakthrough vapors during their respective flows.

In this manner, a three-way valve may be employed to route fuel vapors across a common hydrocarbon sensor (e.g., HC sensor 77) when a change in canister load is expected. The common hydrocarbon sensor measures an amount of fuel vapors flowing past during each fluid flow (e.g., purge flow, loading flow, and breakthrough flow) and conveys these amounts to the controller. The controller may then calculate an existing canister load based on a previously determined load and the estimated change in load based on the type of fluid flowing past the hydrocarbon sensor (e.g., purge flow, loading flow, breakthrough flow).

Figure 4A:
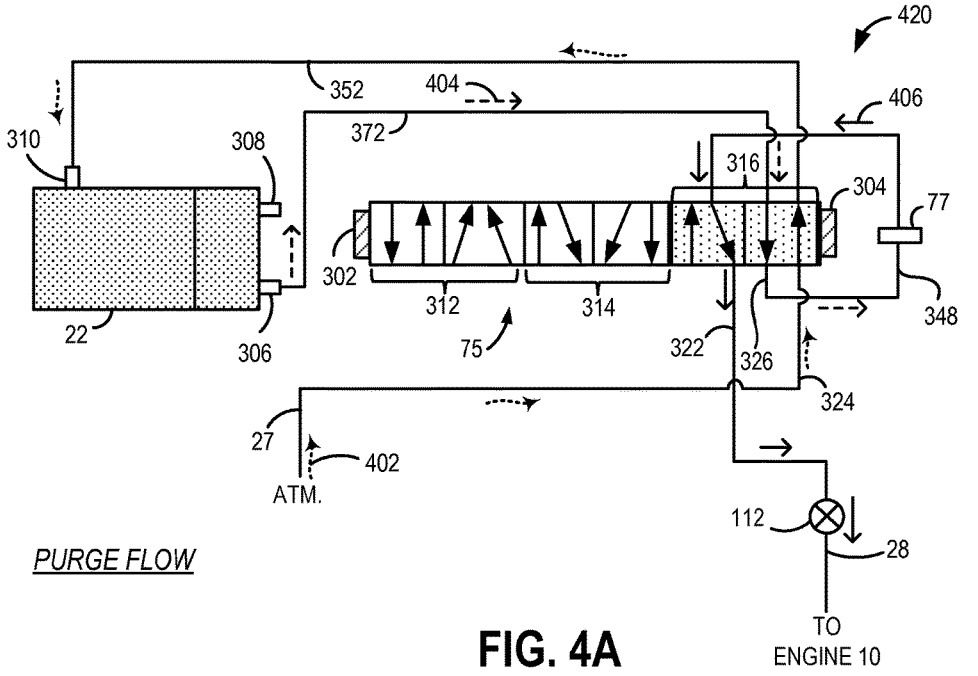
FIGS. 4A, 4B, and 4C schematically portray various states or conformations of the three-way valve.
Figure 4B:
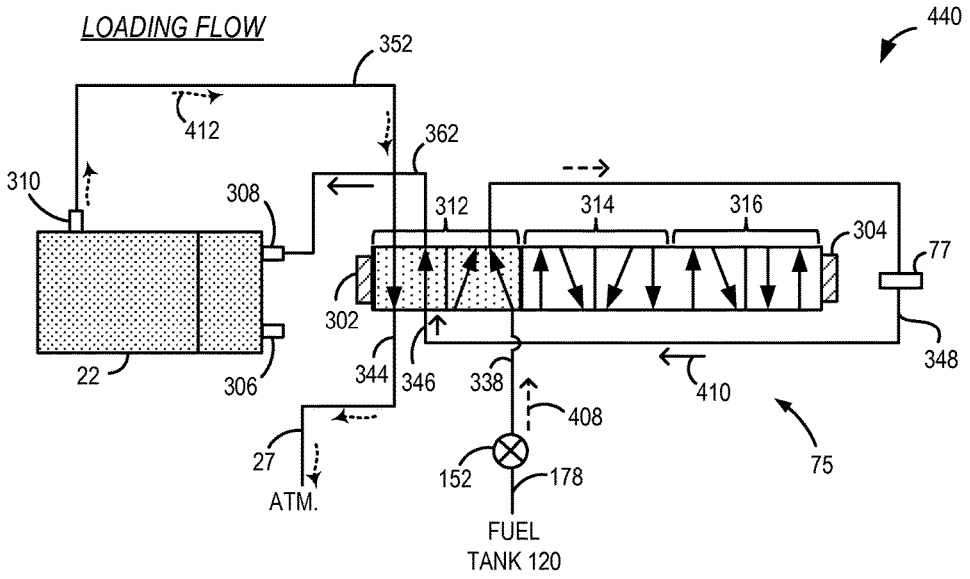
Figure 4C:
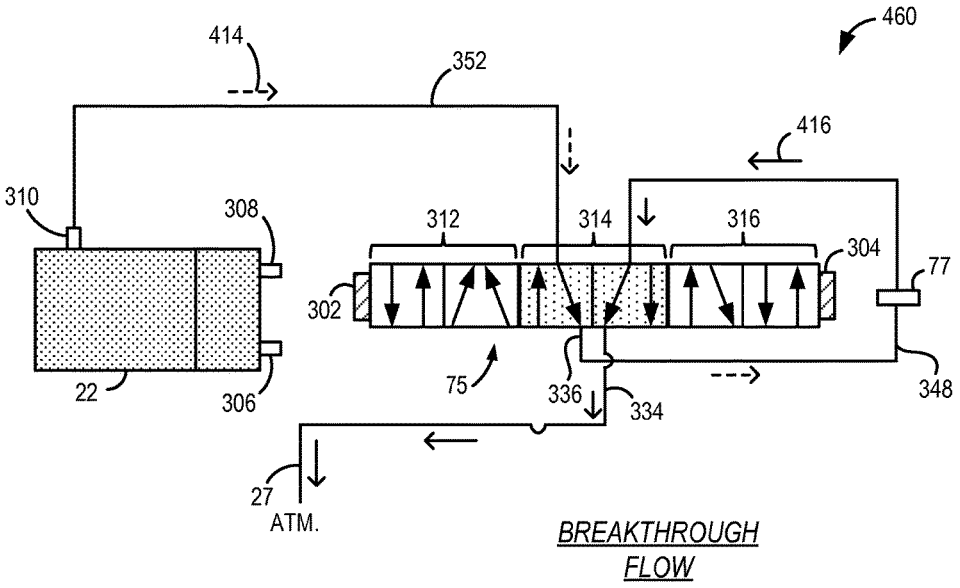

Turning now to FIGS. 4A, 4B, and 4C, they portray example vapor and air flow through the three-way valve and the HC sensor based on the selected position of the three-way valve. FIGS. 4A, 4B, and 4C depict the same components as those shown in FIG. 3. Accordingly, similar components are numbered the same as in FIG. 3.

FIG. 4A presents view 420 depicting an example purge flow routed by the three-way valve 75 through the HC sensor 77. For ease of clarity, many of the channels, links, passages, and conduits introduced in reference to FIG. 3 are not shown. Specifically, channels, links, passages, conduits that do not experience fluid flow during a purge operation are not shown in FIG. 4A. As such, the CPV may be energized to open during the purge operation.

During the purge operation, the three-way valve 75 may be adjusted to a first position by actuating one of the first solenoid 302 and second solenoid 304. For example, controller 12 (of FIG. 1) may communicate a signal to second solenoid 304 to actuate the three-way valve 75 to the first position wherein third segment 316 is utilized for fluid flow (depicted as dotted region). Specifically, second solenoid 304 alone may be energized to actuate the three-way valve 75 to the first position. Accordingly, fluid flow through three-way valve 75 may occur primarily via third segment 316. Further, there may be no fluid flow through either the first segment 312 or the second segment 314 when the three-way valve 75 is in its first position.

To enable the purge operation, fresh air 402 (shown as small dashed arrows 402) is drawn into the vent line 27 and then flows via conduit 324 into third segment 316 of three-way valve 75. Fresh air 402 is then directed to the vent port 310 from third segment 316 of three-way valve 75. Accordingly, fresh air 402 flows along link 352 into vent port 310 of fuel vapor canister 22. The fresh air enables desorption of stored fuel vapors in the fuel vapor canister. Further, desorbed fuel vapors from the canister may then exit the canister via purge port 306. As such, a mix of fresh air and desorbed vapors depicted as large dashed arrow 404 may exit purge port 306 and flow along link 372 towards third segment 316 of three-way valve 75. Desorbed fuel vapors and fresh air (arrow 404) may then flow along path 326 towards HC sensor 77 positioned in common path 348. The HC sensor may thus measure an estimated amount of fuel vapors in the fluid mix flowing through common path 348 during the purge operation. The mix of desorbed fuel vapors and air are depicted as solid arrows 406 after flowing past the HC sensor to visually differentiate them from the arrows indicating desorbed fuel vapors from the canister that have not streamed past HC sensor 77. The mix of desorbed fuel vapors and air is then directed through third segment 316 of three-way valve 75, along passage 322 towards purge line 28 and CPV 112. As such, the mix of desorbed fuel vapors is conducted to the engine for combustion via purge line 28.

Thus, as shown in FIG. 4A, the HC sensor 77 is fluidically coupled to the purge port 306 of canister 22 during the purge operation. Specifically, HC sensor 77 may be in fluidic communication with purge port 306 via each of three-way valve 75, link 372, and path 326. The HC sensor may also be fluidically coupled to the CPV 112 during the purge operation via each of the three-way valve 75 and passage 322.

FIG. 4B depicts view 440 illustrating an example loading flow routed by the three-way valve 75 through the HC sensor 77. Loading flow may include one or more of refueling vapors generated during fuel tank refilling operation, diurnal vapors generated during daily changes in ambient temperature, as well as "running loss" vapors (that is, fuel vaporized during vehicle operation). In mild HEVs and engines equipped with start-stop systems, the VBV may be closed during engine operation and running loss vapors may not be formed. Accordingly, in HEVs and engines equipped with start-stop systems, loading flow may include one or more of refueling vapors and diurnal vapors. Further, in PHEVs, the FTIV may be maintained closed providing a sealed fuel tank during vehicle operation. The FTIV may be opened in response to a refueling event wherein fuel vapors inside the sealed fuel tank may be first released into the fuel vapor canister to depressurize the fuel tank for refueling. Accordingly, the loading flow in a PHEV may include a mixture of refueling vapors and depressurization vapors.

The VBV 152 (or FTIV 152, when present) may be opened in response to a refueling event allowing fuel vapors in fuel tank 120 to flow through conduit 178. Further, the three-way valve 75 may be adjusted to a second position in response to the refueling event. Specifically, first solenoid 302 of three-way valve 75 may be actuated by the controller to adjust the conformation of the three-way valve 75 to the second position wherein the first segment 312 is utilized for fluid flow (denoted by the dotted region in first segment 312). Specifically, first solenoid 302 alone may be energized to actuate the three-way valve 75 to the second position for loading flow. Accordingly, fluid flow through three-way valve 75 during the refueling event may occur primarily via first segment 312. In other words, when the three-way valve 75 is in its second position when the first segment 312 is utilized for fluid flow therethough, there may be no fluid flow through either the second segment 314 or the third segment 316 of the three-way valve.

Thus, fuel vapors from fuel tank 120 denoted as large dashed arrows 408 may flow through conduit 178, past VBV 152 into channel 338 and thereon into first segment 312 of three-way valve 75. The three-way valve then directs the fuel vapors 408 through HC sensor 77 positioned along common path 348. Once the fuel vapors have streamed past the HC sensor, the fuel vapors are denoted by solid arrows 410 (to differentiate from fuel vapors that are yet to flow past the HC sensor). Fuel vapors 410 may then enter the three-way valve 75 via path 346 and are guided along link 362 to load port 308 of canister 22. As fuel vapors enter the canister 22, they may be adsorbed within the adsorbent material in canister 22. Further, air present with the fuel vapors may be expelled from the canister via vent port 310. As such, the air 412 exiting the canister at vent port 310 may be stripped of fuel vapors. Further, air 412 may be guided via link 352 towards first segment 312 of three-way valve 75. Further still, the air 412 may then be conducted via conduit 344 towards vent line 27 and therethrough into atmosphere.

Thus, as shown in FIG. 4B, the HC sensor 77 is fluidically coupled to the load port 308 of canister 22 during the loading flow (e.g., during refueling). Specifically, HC sensor 77 may be in fluidic communication with load port 308 via each of three-way valve 75, link 362, and path 346. The HC sensor may also be fluidically coupled to VBV 152 (and fuel tank 120) during the loading flow via each of the three-way valve 75 and channel 338.

FIG. 4C includes view 460, which depicts an example breakthrough flow from the fuel vapor canister 22 into the atmosphere via the three-way valve 75. Breakthrough flow from the canister may occur, in one example, during a non-combusting mode of vehicle operation. For example, a hybrid vehicle may be operating in an engine-off mode without engine combustion and the motor propelling the vehicle. Herein, the engine may be deactivated, e.g. shut down and at rest. In the example of a vehicle equipped with a start-stop system, the vehicle may be idling at a stop light and the engine may be shut down to rest to reduce fuel consumption during idle. Herein, the engine may not be combusting. Breakthrough flow of fuel vapors may also occur when a vehicle (either hybrid or non-hybrid) is parked for long durations (without engine combustion) in hot ambient conditions. The vehicle may be in a prolonged soak in hot weather. The canister may be heated due to the higher ambient temperature and may bleed stored fuel vapors into the atmosphere.

Thus, when the engine is not combusting due to one of a hybrid vehicle operating in engine-off mode, an engine shut down due to an idle stop mode, and when the vehicle is parked with the engine shut down, the three-way valve may be adjusted to a third position to enable measuring an amount of breakthrough vapors. As such, neither the first solenoid 302 nor the second solenoid 304 of three-way valve 75 may be energized (or actuated) in the third position. For example, the third position of the three-way valve 75 may be a default position of the three-way valve. As such, the three-way valve 75 may not have significant power consumption (e.g., may have minimal or no power consumption) in the third position. Further, when in the third position, the second segment 314 of the three-way valve 75 may be utilized for fluid flow. Accordingly, fluid flow through three-way valve 75 may occur primarily via second segment 314. In other words, when the three-way valve is in its third position, fluid flow may not occur through either the first segment or the third segment of the three-way valve.

It will also be noted that the three-way valve may be placed in the third position (e.g., the default position) when the engine is operating and combusting without a concurrent purging operation. In this third position, each of the first solenoid 302 and the second solenoid 304 are un-energized enabling a reduction in power consumption.

As such, if the canister is bleeding emissions due to breakthrough, fuel vapors may exit the canister via vent port 310. These breakthrough fuel vapors are denoted as large dashed arrows 414. These breakthrough vapors 414 flow into three-way valve 75 via link 352. The three-way valve then directs the breakthrough vapors 414 to HC sensor 77 via path 336 and common path 348. Once the breakthrough vapors have flown past the HC sensor, they are represented by solid arrows 416. These breakthrough vapors 416 then flow through second segment 314 of three-way valve 75 into conduit 334 and thereon into vent line 27 and the atmosphere. Herein, the three-way valve is adjusted to the third position to enable fluidic communication between the HC sensor 77 and vent port 310. As such, HC sensor 77 is fluidically coupled to the vent port 310 of canister 22 during breakthrough flow. Specifically, HC sensor 77 may be in fluidic communication with vent port 310 via each of three-way valve 75, link 352, and path 336 (as well as common path 348). The HC sensor may also be fluidically coupled to vent line 27 during the breakthrough flow via each of the three-way valve 75 and conduit 334.

In this manner, the three-way valve may route each of a purge flow, a loading flow, and breakthrough flow past a single common hydrocarbon sensor. Further, the single common hydrocarbon sensor may estimate or measure an amount of fuel vapors in each of the purge flow, the loading flow, and the breakthrough flow. Further still, canister load may be determined based on the amount of fuel vapors in each of the purge flow, the loading flow, and the breakthrough flow.

It will be appreciated that in the description of fluid flow above for each position of the three-way valve, there may be no additional intervening components in the flow path than those specified in the description or shown in the corresponding figures.

Table 500 of FIG. 5 presents detailed information about the position of the three-way valve and corresponding coupling as well as corresponding fluid flows. As such, table 500 will be explained with reference to the system of FIG. 1 as well as to the three-way valve 75 in FIGS. 3, 4A, 4B, and 4C.

The three-way valve may be adjusted to a first position (or position 1) in response to a purge operation in the engine (as shown in FIG. 4A) or in a canister purging mode. Herein, the three-way valve may enable fluidic coupling between the HC sensor and a purge port of the fuel vapor canister. As such, the HC sensor may now receive a flow of purge fuel vapors from the fuel vapor canister. Specifically, desorbed fuel vapors from the fuel vapor canister (along with air) may flow past HC sensor 77 while being purged into the intake manifold of the engine. In the canister purging mode, the HC sensor may therefore estimate an amount of fuel vapors desorbed from the fuel vapor canister. The HC sensor may also be fluidically coupled to purge line 28 when the three-way valve 75 is at its first position.

The three-way valve may be adjusted to a second position (or position 2) in response to a refueling event of the vehicle. As such, the mode may be termed a refueling mode. Herein, the three-way valve may enable fluidic communication between the HC sensor and a load port of the fuel vapor canister. Specifically, as shown in FIG. 4B, fuel vapors exiting the fuel tank in the form of loading flow may flow past the HC sensor before entering the load port of the fuel vapor canister. Thus, the HC sensor may estimate or measure an amount of loading vapors entering the canister for adsorption or storage. Specifically, the three-way valve in its second position routes fuel vapors from the fuel tank through the HC sensor before the loading flow enters the load port of the canister. As explained earlier, the loading flow may include one or more of refueling vapors, diurnal vapors, and running loss vapors. The loading flow may also include fuel vapors released due to depressurization of the fuel vapor canister in a PHEV. The loading flow may be directed to the canister from the fuel tank.

The three-way valve may be adjusted to a third position (or position 3) when the vehicle is operating in an engine-off or engine deactivated mode. As described earlier, the engine may be deactivated by being shut down to rest when the vehicle is parked, or when a hybrid vehicle is being propelled primarily by the motor. Herein, the three-way valve may enable fluidic coupling between the HC sensor and the vent port of the canister, as described earlier in reference to FIG. 4C. The HC sensor may receive breakthrough flow or fuel vapors bleeding from the canister into the atmosphere. Further, the HC sensor may measure or estimate an amount of breakthrough vapors exiting the fuel vapor canister. Specifically, the three-way valve routes breakthrough vapors from the fuel system canister past the HC sensor before the breakthrough vapors exit into the atmosphere.

It will be noted that though table 500 lists a first position of the three-way valve for estimating fuel vapors in purge flow, a second position of the three-way valve for estimating fuel vapors in loading flow, and a third position of the three-way valve for estimating fuel vapors in breakthrough flow, alternate embodiments may include distinct positions for the three vapor flows. For example, in an alternative embodiment, the three-way valve may be placed in a second position to route purge flow to the HC sensor. Further, the three-way valve may be adjusted to a first position to determine breakthrough flow while a third position of the three-way valve may enable determining loading flow.

In an example representation, a method may comprise using a single, common hydrocarbon sensor to determine canister load based on each of a first amount of fuel vapors adsorbed within a canister, a second amount of fuel vapors desorbed from the canister, and a third amount of fuel vapors that breakthrough from the canister.

Figure 6A:
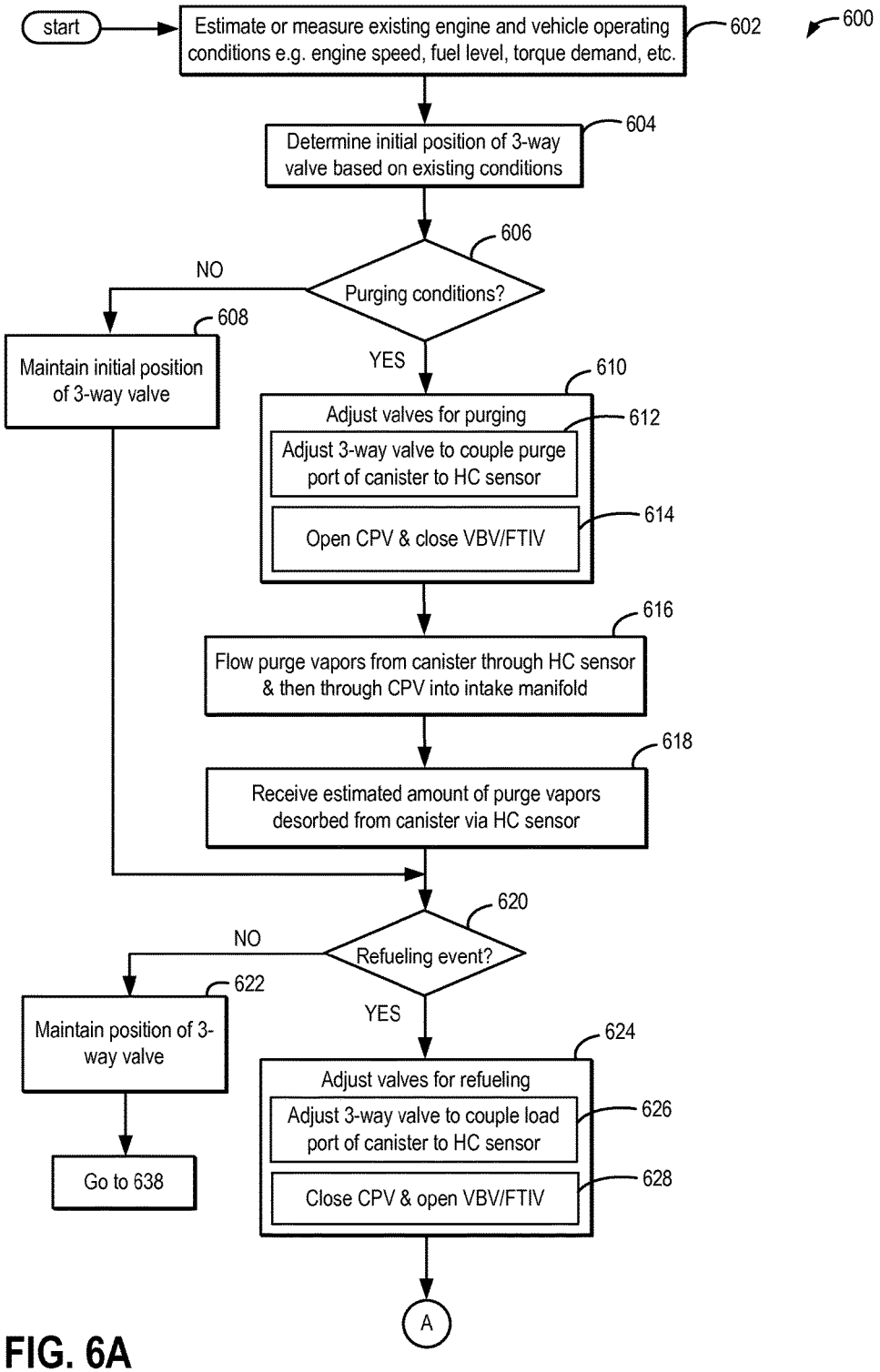
FIGS. 6A and 6B show an example flowchart illustrating a routine to adjust the three-way valve based on existing engine and vehicle conditions.
Figure 6B:
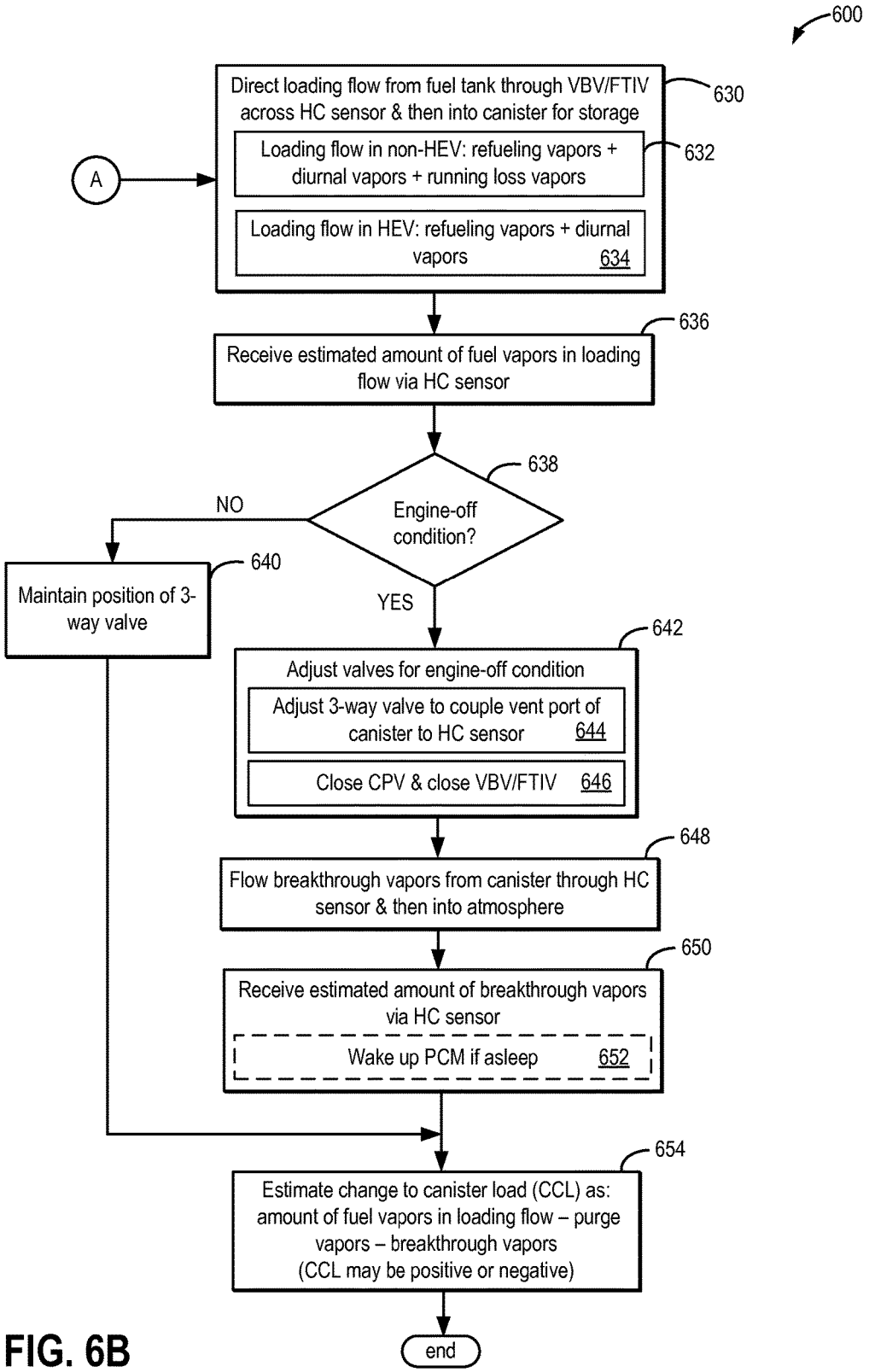

Referring now to FIGS. 6A and 6B, they depict an example routine 600 for determining a change in load of a fuel vapor canister. The load of the canister may be an amount of fuel vapors stored in the fuel vapor canister. Specifically, routine 600 includes adjusting a status of a three-way valve, such as the three-way valve 75 of FIGS. 1 and 3, to enable routing of fuel vapors past a HC sensor. Further, the example routine 600 also estimates the change in canister load based on feedback from the HC sensor during each of the routings. As such, the load of the fuel vapor canister may be estimated based on each of a purge flow, a breakthrough flow, and a loading flow past the HC sensor.

Routine 600 (and routine 700 of FIG. 6) will be described in relation to the system shown in FIG. 1, and FIGS. 3, 4A, 4B, and 4C but it should be understood that similar routines may be used with other systems without departing from the scope of this disclosure. Instructions for carrying out routine 600 included herein may be executed by a controller, such as controller 12 of FIG. 1, based on instructions stored on a memory of the controller and in conjunction with signals received from sensors of the engine system, such as the sensors described above with reference to FIG. 1. The controller may employ engine actuators of the engine system, such as the actuators of FIG. 1 to adjust engine operation and vehicle operation, according to the routines described below.

At 602, routine 600 includes estimating and/or measuring existing engine and vehicle conditions. For example, routine 600 may determine if the vehicle is being propelled by an engine or a motor (if a hybrid vehicle) and if the engine is shut down to rest, such as at an idle stop. Further still, routine 600 may estimate engine speed, load, air-fuel ratio, an existing fuel level in a fuel tank, etc. Next, at 604, routine 600 determines an initial position or conformation of the three-way valve. The initial position of the three-way valve may be selected based on existing engine conditions. For example, if the vehicle is operating in an engine-off (e.g. non-combusting) mode, the initial position of the three-way valve may be the position that fluidically couples the vent port of the canister to the HC sensor, such as in FIG. 4C for breakthrough flow.

At 606, routine 600 determines if purging conditions are present. For example, a purging operation may be determined based on one or more of an existing canister load, a duration since a previous purging, and the emissions catalyst attaining light-off temperature. Further still, purging conditions may also include an engine-on condition as engine combustion is desired for combusting purged fuel vapors from the canister. Furthermore, the engine-on condition may also provide intake manifold vacuum to draw purged vapors into the engine intake. If it is determined that purging conditions are not present, routine 600 progresses to 608 where the initially selected position for the three-way valve is maintained. Routine 600 then proceeds to 620. If, however, purging conditions are confirmed, routine 600 continues to 610 to adjust various valves for purging. At 612, the three-way valve is adjusted to a position that couples the purge port of the fuel vapor canister fluidically to the HC sensor. Simultaneously, at 614, the CPV may be opened while the VBV (or FTIV, if present) is closed.

For example, with reference to FIG. 4A, the three-way valve may be placed in a first position wherein purged vapors from the canister are routed past the HC sensor as they flow towards the purge line and into the intake manifold of the engine. Further still, the first position of the three-way valve also enables fluidic communication between the vent port of the canister and the vent line (and atmosphere). By providing fluidic communication between the canister and the atmosphere, fresh air may be drawn into the canister to impel desorption of stored fuel vapors.

Further, the CPV may be opened from a closed position to allow the flow of purged vapors therethrough. The controller may command an actuator (e.g. a solenoid actuator) to adjust the CPV to an open position wherein the flow of purge vapors through the CPV occurs without flow restriction. Likewise, if the VBV (or the FTIV) is at a fully open position previously, the controller may command an actuator to close the VBV (or FTIV). For example, the VBV (or FTIV) may be actuated to a fully closed position by an electromechanical actuator.

With the valves adjusted to their desired positions, at 616, purge vapors flow from the canister past the HC sensor through the CPV into the intake manifold. As the purge vapors (and fresh air drawn in for desorption) flow past the HC sensor, the HC sensor may measure an amount of purge vapors (e.g., hydrocarbon vapors) in the fluid flow. Accordingly, at 618, routine 600 receives the amount of purge vapors desorbed from the canister during the purge operation from the HC sensor. This amount of purge vapors may be stored in a memory of the controller.

Next, at 620, routine 600 determines if a refueling event is anticipated. A refueling event may be anticipated, in one example, based on unlocking of a refueling lock. In another example, the refueling event may be confirmed when a fueling nozzle is inserted into the fuel filling system. If the refueling event is not confirmed, routine 600 proceeds to 622 to maintain an existing position of the three-way valve. The three-way valve may be maintained at its existing position by either actuating or energizing one of the two solenoids, first solenoid 302 and second solenoid 304 of FIG. 3 or by maintaining the two solenoids de-energized. As such, the controller may either continue to send a signal to actuate one of the two solenoids, or may continue to maintain the two solenoids deactivated. Further, routine 600 proceeds to 638 of routine 600, which will be described later.

If the refueling event is confirmed, routine 600 continues to 624 to adjust various valves for the refueling event. At 626, the three-way valve is adjusted to fluidically couple the load port of the canister to the HC sensor. At the same time, the CPV is adjusted closed if previously open, and the VBV (or the FTIV, if present) is opened at 628 to enable fluidic communication between the three-way valve and the fuel tank. By opening the VBV or FTIV, fuel vapors stored in the fuel tank, such as diurnal vapors, may be transferred to the fuel vapor canister to depressurize the fuel tank for refueling. Further, as refueling begins, additional fuel vapors generated during the refueling operation (e.g., refueling vapors) may be conveyed to the fuel vapor canister.

For example, with reference to FIG. 4B, the three-way valve may be placed in a second position wherein fuel vapors from the fuel tank are routed past the HC sensor as they flow towards the fuel vapor canister for adsorption. Further, the second position of the three-way valve also fluidically couples the fuel tank and VBV (or FTIV) to the HC sensor via the three-way valve. Further still, fluidic communication between the vent port of the canister and the vent line (and atmosphere) may be enabled by the second position of the three-way valve. By providing fluidic communication between the canister and the atmosphere, air stripped of fuel vapors may be expelled from the canister after adsorption of fuel vapors received from the fuel tank.

Next, at 630, loading flow from the fuel tank is streamed across the HC sensor before flowing into the fuel vapor canister. By adjusting the three-way valve to the second position to couple the load port of the canister to the HC sensor (as well as the fuel tank to the HC sensor), the loading flow streams past the HC sensor as the loading flow is conducted to the fuel vapor canister. Loading flow in a non-hybrid vehicle may include one or more of refueling vapors, diurnal vapors, and running loss vapors, as shown at 632. However, for hybrid vehicles or engines equipped with start-stop systems, the loading flow may include one or more of refueling vapors and diurnal vapors, as shown at 634. For plug-in hybrid electric vehicles, the loading flow includes refueling vapors and fuel vapors stored in the sealed fuel tank during vehicle operation, which may be released as the fuel tank is depressurized prior to refueling.

Next at 636, routine 600 receives an estimated amount of fuel vapors in the loading flow as sensed by the HC sensor. Specifically, the HC sensor may measure an amount of hydrocarbons such as refueling vapors, diurnal fuel vapors, running loss vapors, etc. in the loading flow, and communicate this amount to the controller. The amount of fuel vapors in the loading flow may be stored in a memory of the controller.

At 638, routine 600 confirms if existing conditions include an engine-off condition. Specifically, the routine may confirm that the existing condition is an engine-off condition without a concurrent refueling event. The engine-off condition includes the engine being shut down to rest such that the engine is not combusting. In one example, the engine may be shut down to rest when the vehicle is keyed-off (e.g., the vehicle is powered off) and parked (without a refueling event). For example, the vehicle may be in a soak mode. In another example, such as in a hybrid vehicle, the engine may not be combusting during an engine-off mode of vehicle operation wherein the vehicle is propelled via motor torque. In yet another example, such as in a vehicle equipped with a start-stop system, the engine may be deactivated (e.g., engine-off condition) without combusting during an idling condition.

If the engine-off condition is not confirmed, routine 600 moves to 640 to maintain an existing status of the three-way valve. Routine 600 may then proceed to 654 which will be described further below. If the engine-off condition is confirmed at 638, routine 600 proceeds to 642 to adjust various valves for the engine-off condition. For example, at 644, the three-way valve is placed in a third position that couples the vent port of the canister to the HC sensor. As such, fuel vapors stored in the canister may break through into the atmosphere creating bleed emissions. Breakthrough flow may be increased when the engine is deactivated. Further, bleed emissions may also occur when the vehicle is parked and soaking in hot weather conditions. An increase in the canister temperature during hot soaks may facilitate breakthrough emissions, for example.

At 646, the CPV may be closed, if previously open, and the VBV (or FTIV) may also be closed, if formerly open. The CPV may be closed during engine-off conditions to reduce a likelihood of fuel vapors from the canister entering the engine. Fluid flow through the VBV (or FTIV) may be blocked during engine-off conditions when a refueling event is not occurring to reduce the transfer of fuel vapors from the fuel tank into the canister.

By placing the three-way valve in a position that couples the vent port of the canister to the HC sensor, and further couples the HC sensor to the vent line, bleed emissions (or breakthrough vapors) exiting the canister can flow past the HC sensor on their way to the vent line. As such, at 648, breakthrough vapors flow from the vent port of the canister, across the HC sensor, and then into the atmosphere via the vent line. The HC sensor can thereby measure an amount of fuel vapors in the breakthrough flow. At 648, routine 600 receives an estimated amount of breakthrough vapors from the HC sensor. Herein, the powertrain control module (or the controller) may be woken up, if asleep, to detect fuel vapors exiting the fuel vapor canister via breakthrough at 652. For example, the powertrain control module may have a capability to sleep and be woken up. Alternatively, the powertrain control module may be kept alive by plugging in a PHEV for recharging.

Next, at 654, routine 600 calculates a change in canister load (CCL) by subtracting each of the amount of purge vapors and the amount of breakthrough vapors from the amount of fuel vapors in the loading flow. As such, the change in canister load may be positive or negative. For example, if the canister has experienced a purge operation without experiencing a loading flow since a previous calculation of canister load, the change in canister load may be negative (e.g., canister load decreases). In another example, if a refueling event has added additional fuel vapors into the fuel vapor canister since the previous calculation, the change in canister load may be positive. Herein, the canister load may increase. In yet another example, if a hybrid vehicle is operated in an engine-off mode (e.g., with motor torque alone) after a refueling event and stored fuel vapors bleed into the atmosphere from the canister during the engine-off mode, the change in canister load may be positive. Specifically, the change in canister load may be positive if the loading flow during the refueling event provides a higher amount of fuel vapors to the canister than the amount of fuel vapors lost to the atmosphere via breakthrough. Routine 600 then ends.

Thus, the three-way valve may be adjusted to one of three positions based on an existing condition (e.g., refueling event, non-combusting mode of vehicle operation, purging operation, etc.). In each of these three positions, fuel vapors may be routed by the three-way valve past the HC sensor allowing the HC sensor to measure the amount of fuel vapors in each type of flow. Therefore, the HC sensor may be exposed to fluid flow (e.g., fuel vapor flow) during each purge operation, each refueling event, and during each non-combusting mode of vehicle operation. Accordingly, the HC sensor may estimate the amounts of fuel vapor entering the fuel vapor canister and/or exiting the fuel vapor canister enabling a calculation of a change in canister load. Further, the change in canister load may be updated each time one of a purge operation, a refueling event, and a non-combusting mode of engine operation occurs.

Figure 7:
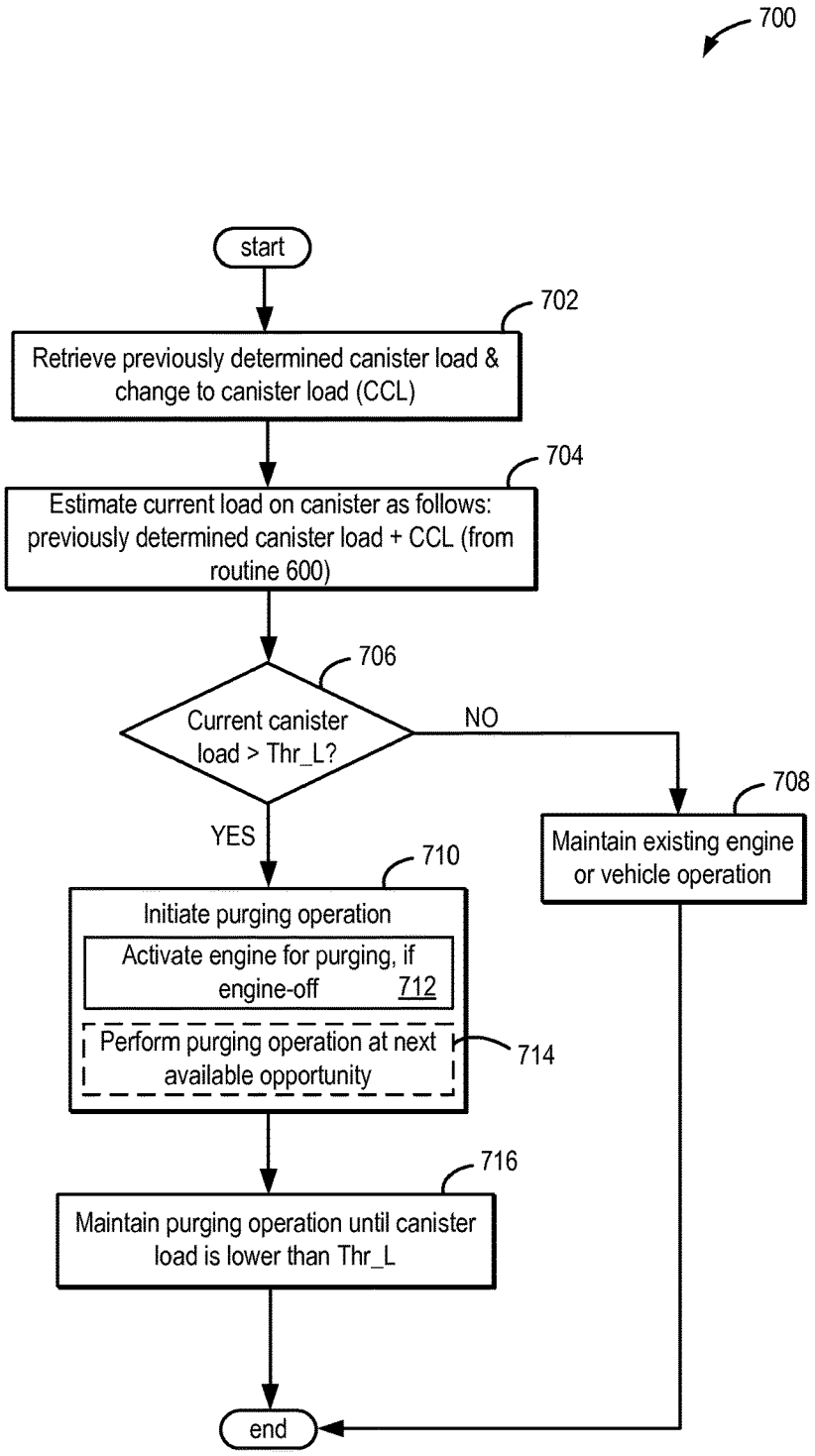
FIG. 7 depicts an example flowchart illustrating a routine to determine a load of a fuel vapor canister included in the evaporative emissions system.
Figure 8:
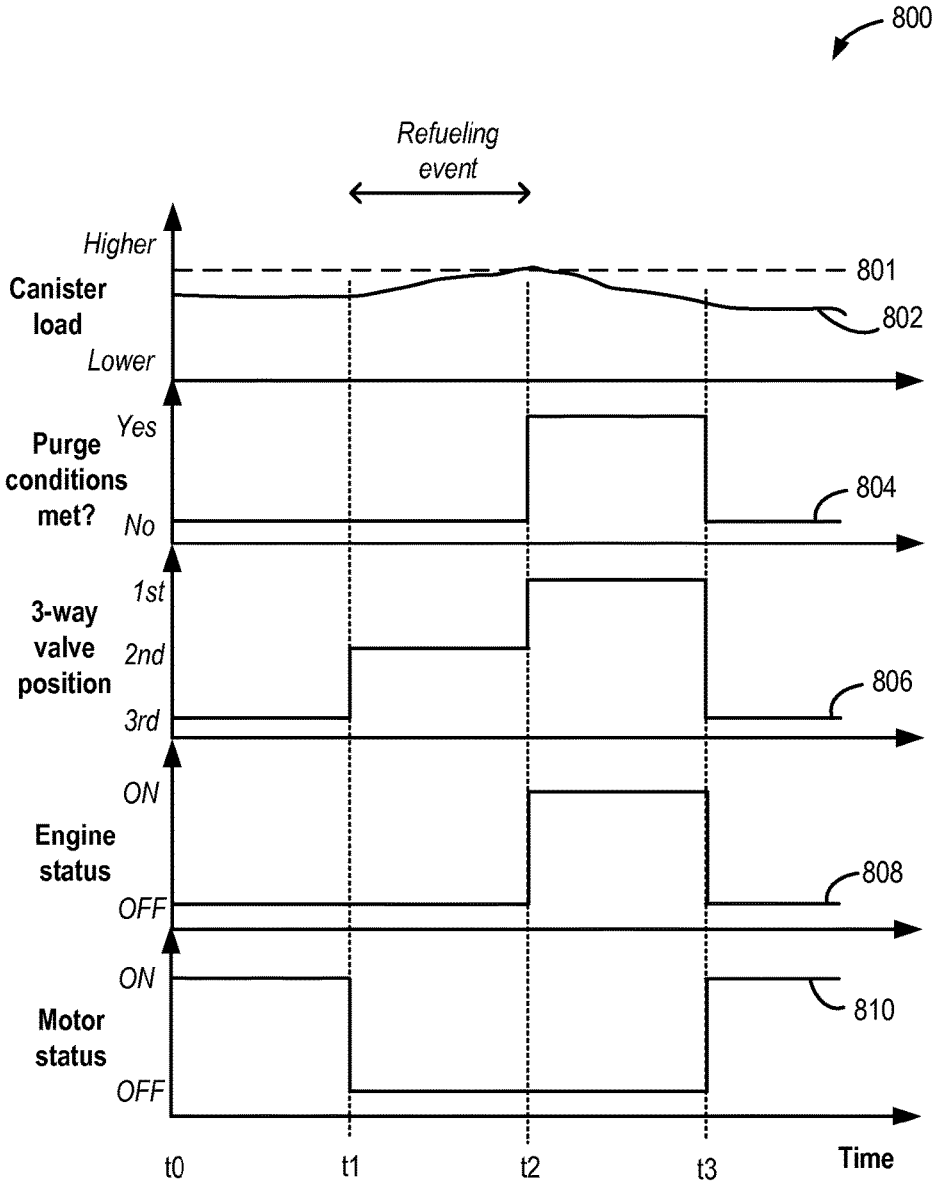
FIG. 8 portrays example adjustments to the three-way valve based on existing vehicle conditions.

Turning now to FIG. 7, it presents routine 700 for determining an existing canister load based on a previously determined canister load and a change in canister load, as estimated by routine 600 of FIGS. 6A and 6B. Further, routine 700 activates a purging operation in response to determining that the existing canister load is higher than a threshold thereby allowing a reduction in canister load. In one example, routine 700 may be initiated after the completion of routine 600. Further, routine 700 may be initiated every time routine 600 is completed. In another example, routine 700 may be initiated after a pre-determined number of repetitions of routine 600.

Routine 700 is described in reference to the system of FIG. 1. Instructions for carrying out routine 700 included herein may be executed by a controller, such as controller 12 of FIG. 1, based on instructions stored on a memory of the controller and in conjunction with signals received from sensors of the engine system, such as the sensors described above with reference to FIG. 1. The controller may employ engine actuators of the engine system, such as the actuators of FIG. 1 to adjust engine operation and vehicle operation, according to the routines described below.

At 702, routine 700 retrieves a previously determined canister load. For example, the controller may have stored an estimate of canister load determined in a preceding calculation of existing canister load in its memory. This estimate of canister load determined in the preceding calculation may be retrieved at 702.

Next, at 704, routine 700 estimates an existing or current canister load based on the change in canister load determined at 654 in routine 600 of FIGS. 6A and 6B. Specifically, the existing canister load is estimated by adding the change in canister load to the previously determined canister load. If the change in canister load is a positive amount and the previously determined canister load is a positive number, the current canister load may be a higher amount than the previously determined canister load. In another example, if the change in canister load determined at 654 in routine 600 is negative and the previously determined canister load is a positive number, the current canister load may be an amount that is lower than the previously determined canister load.

Thus, the canister load may be based on output from a HC sensor in response to each of a purge flow, a loading flow, and a break through flow.

Next, at 706, routine 700 determines if the existing canister load is higher than a threshold level, Thr_L. In one example, the threshold level may be based on a volume of the canister. For example, Thr_L may be 90% of the volume of the canister. In another example, Thr_L may be 95% of the volume of the canister. The threshold level may determine whether the canister can adsorb additional fuel vapors. Thus, if it is determined that the existing canister load is lower than Thr_L, routine 700 continues to 708 to maintain an existing status of vehicle and/or engine operation. For example, if the vehicle is operating in an engine-off mode (e.g., a hybrid vehicle being propelled primarily by the motor), the vehicle may continue to be operated in the engine-off mode. Routine 700 then ends.

However, if it is confirmed that the existing canister load is higher than the threshold level, routine 700 progresses to 710 to initiate a purging operation. For example, if the vehicle is operating in engine-off mode, the engine may be activated at 712 to enable purging of the canister. If the vehicle is operating with the engine activated and combusting, one or more valves may be adjusted to enable the purge operation. For example, the CPV may be opened (from closed) and the three-way valve may be adjusted to a position, e.g., a first position of table 500, to enable routing fresh air from the atmosphere into the canister, and to conduct purged vapors from the canister past the HC sensor before the purged vapors flow through the purge line to enter the engine intake manifold.

If a purging operation cannot be initiated immediately, routine 700 may optionally wait to perform the purging operation at the next available opportunity at 714. For example, purging of the canister may not be initiated if the emissions catalyst has not reached light-off temperature.

At 716, the purging operation is continued until the canister load is lower than the threshold level, Thr_L. The controller may estimate a change in canister load, as described earlier in reference to routine 600 (606-618), based on output from the HC sensor during the purge operation. Specifically, a reduction in the load of the fuel vapor canister may be estimated. As such, the HC sensor may measure the amount of fuel vapors exiting the canister in the purge flow and the canister load may be continuously updated based on the measured amount of purged vapors. Routine 700 then ends.

In this manner, the HC sensor estimates an amount of fuel vapors exiting or entering the fuel vapor canister. By continuously estimating the change in canister load, an existing canister load can be constantly monitored. As such, the controller may maintain a tally of existing canister load. Further, a purge operation may be initiated in response to the existing canister load being higher than a threshold level.

Referring now to FIG. 8, it includes map 800 illustrating example adjustments of a three-way valve, such as three-way valve 75 of FIGS. 1 and 3, in response to different engine conditions and events. As such, map 800 will be described in relation to the vehicle and engine system shown in FIGS. 1 and 2. For example, the vehicle in this example may be a hybrid vehicle. Map 800 depicts canister load at plot 802, a check for purging conditions being met at plot 804, position of the three-way valve at plot 806, engine status at plot 808, and motor status at plot 810. Line 801 represents a threshold level (Thr_L) for canister load. All plots are shown over time, along the x-axis. Further, time increases from the left of the x-axis towards the right. Note that elements aligning at a common time on the graph, such as at time t1, for example, are occurring concurrently, including for example where one parameter is increasing while another parameter is decreasing.

At t0, the vehicle may be operating in an engine-off mode (plot 808) with vehicle being propelled using motor torque. Specifically, the engine may not be combusting and may be shut down to rest while the motor is operating the vehicle (plot 810). Further, canister load may be moderate and lower than the threshold level (line 801). Since the canister load is lower than the threshold level and the engine is not combusting, purging conditions may not be met at t0. Further still, as the engine is not combusting, the three-way valve is adjusted to the third position (as shown in FIG. 5) to couple the HC sensor to the vent port of the canister. Herein, the HC sensor may measure an amount of breakthrough vapors, if the canister bleeds emissions. Between t0 and t1, the canister load may not change substantially as the canister may not bleed significant emissions. For example, the canister may have few or no leaks.

At t1, a refueling event may be initiated. The motor may be shut down (to OFF) and the engine may continue to be deactivated (at OFF). Further, the three-way valve may be adjusted to the second position to enable loading flow to stream past the HC sensor. As such, the HC sensor may be fluidically coupled to the load port of the canister and may measure an amount of vapors in the loading flow (e.g., refueling vapors, diurnal vapors, etc.) as described in reference to FIG. 4B. As the loading flow streams into the canister and fuel vapors are adsorbed in the canister, the canister load (based on feedback from the HC sensor) increases steadily and reaches the threshold level at t2.

In response to the canister load rising to the threshold level, purging conditions may be considered met. Accordingly, the engine may be activated at t2 and the three-way valve may be adjusted to the first position for purge flow. As such, the motor may remain deactivated between t1 and t3. Vapors purged from the canister may flow past the HC sensor towards the CPV and the engine. The HC sensor therefore measures an amount of vapors exiting the canister and canister load reduces in response to the purging operation between t2 and t3. At t3, in response to the canister load reducing substantially below the threshold level, the engine may be deactivated to OFF and the vehicle may be propelled primarily via motor torque by activating the motor at t3. Further, the three-way valve may be shifted to the third position as the engine is no longer combusting.

In this way, canister load may be estimated by using a three-way routing valve and a single hydrocarbon sensor. The technical effect of monitoring the amounts of fuel vapors entering and exiting the fuel vapor canister includes estimating the loading state of a fuel vapor canister more accurately. Further, a continuous account of the existing canister load may be maintained. By learning the existing canister load in a continuous manner, canister purge may be initiated when stored fuel vapor concentration in the fuel vapor canister is higher than desired. Accordingly, saturation of the fuel vapor canister may be reduced allowing for a reduction in breakthrough emissions. Overall, emissions compliance may be improved while enhancing the performance of the emissions control system.

Thus, one example method for an evaporative emissions system in a vehicle may comprise routing each of a purge flow from a fuel vapor canister, a loading flow into the fuel vapor canister, and a breakthrough flow from the fuel vapor canister through a hydrocarbon sensor, and determining a load of the fuel vapor canister based on output from the hydrocarbon sensor during each of the routings. The hydrocarbon sensor may be a single, common sensor for each of the purge flow, the loading flow, and the breakthrough flow. As such, the purge flow from the fuel vapor canister may be additionally or optionally delivered to an intake manifold of an engine of the vehicle, the loading flow into the fuel vapor canister may be additionally or optionally received from a fuel tank coupled in the vehicle, and the breakthrough flow may be additionally or optionally directed to atmosphere from the fuel vapor canister. In the preceding example, the purge flow from the fuel vapor canister may additionally or optionally include purge vapors, and breakthrough flow may additionally or optionally include breakthrough vapors. In any or all of the preceding examples, the loading flow into the fuel vapor canister from the fuel tank may additionally or optionally include one or more of refueling vapors, diurnal vapors, and running loss vapors. In any or all of the preceding examples, the vehicle may additionally or optionally be a hybrid vehicle, and wherein the loading flow into the fuel vapor canister from the fuel tank may additionally or optionally include one or more of refueling vapors and diurnal vapors. In any or all of the preceding examples, output from the hydrocarbon sensor may additionally or optionally include a first amount of fuel vapors in the loading flow, a second amount of fuel vapors in the purge flow, and a third amount of breakthrough vapors in the breakthrough flow. In any or all of the preceding examples, determining the load of the fuel vapor canister based on output from the hydrocarbon sensor may additionally or optionally include subtracting each of the second amount of fuel vapors in the purge flow and the third amount of fuel vapors in the breakthrough flow from the first amount of fuel vapors in the loading flow. In any or all of the preceding examples, the method may additionally or optionally further comprise adjusting a three-way valve to route each of the purge flow, the loading flow, and the breakthrough flow through the hydrocarbon sensor. In any or all of the preceding examples, the method may additionally or optionally further comprise enabling a canister purge operation if the load of the fuel vapor canister is higher than a load threshold.

Another example method may comprise adjusting a three-way valve to a first position to flow purge vapors from a canister through a hydrocarbon sensor, adjusting the three-way valve to a second position to flow refueling vapors from a fuel tank into the canister via the hydrocarbon sensor, adjusting the three-way valve to a third position to flow breakthrough vapors from the canister into atmosphere via the hydrocarbon sensor, and determining a load of the canister based on output from the hydrocarbon sensor during each adjusting of the three-way valve. In the preceding example, the method may additionally or optionally further comprise initiating a canister purge in response to the load of the canister being higher than a threshold load. In any or all of the preceding examples, the hydrocarbon sensor may additionally or optionally estimate each of an amount of purge vapors desorbed from the canister during canister purge, an amount of refueling vapors adsorbed into the canister from the fuel tank, and an amount of breakthrough vapors exiting the canister. In any or all of the preceding examples, each of the amount of breakthrough vapors and the amount of purge vapors may be additionally or optionally subtracted from the amount of refueling vapors to determine a change in canister load, and wherein the load of the canister may be additionally or optionally determined by adding the change in canister load to a previously determined load of the canister. In any or all of the preceding examples, the previously determined load of the canister may be additionally or optionally stored in a memory of a controller. In any or all of the preceding examples, the load of the canister may be additionally or optionally determined in response to each of a purging operation, a refueling operation, and an engine-off mode of operation of a vehicle, the vehicle being a hybrid vehicle.

One example system for a vehicle may comprise an engine, a fuel system including a fuel tank, a fuel system canister including a load port, a purge port, and a vent port, a canister purge valve, a vent line coupling the fuel system canister to a fresh air source, a three-way valve coupled to a hydrocarbon sensor, the three-way coupled to each of the loading port, the purge port, and the vent port of the fuel system canister, and the canister purge valve, the vent line, and the fuel tank and a controller configured with computer readable instructions stored on non-transitory memory for in response to a purging operation, adjusting a position of the three-way valve to fluidically couple the hydrocarbon sensor to the purge port of the fuel system canister, in response to a refueling event, adjusting the position of the three-way valve to fluidically couple the hydrocarbon sensor to the loading port of the fuel system canister, and in response to one of a non-combusting mode of vehicle operation and a vehicle park mode, adjusting the position of the three-way valve to fluidically couple the hydrocarbon sensor to the vent port of the fuel system canister. In the preceding example, during the purging operation, desorbed fuel vapors may additionally or optionally flow from the purge port of the fuel system canister via the three-way valve, the hydrocarbon sensor, and the canister purge valve into an intake manifold of the engine, and wherein the hydrocarbon sensor additionally or optionally measures an amount of desorbed fuel vapors flowing therethrough. In any or all of the preceding examples, during the refueling event, refueling vapors may additionally or optionally flow from the fuel tank to the load port of the fuel system canister via the three-way valve and the hydrocarbon sensor, and wherein the hydrocarbon sensor may additionally or optionally measure an amount of refueling vapors flowing therethrough. As such, the refueling vapors may be combined with diurnal vapors and/or running loss vapors. In any or all of the preceding examples, during one of the non-combusting mode of vehicle operation and vehicle park mode, breakthrough fuel vapors may additionally or optionally flow from the vent port of the fuel system canister via the three-way valve and the hydrocarbon sensor through the vent line into atmosphere, and wherein the hydrocarbon sensor may additionally or optionally measure an amount of breakthrough fuel vapors flowing therethrough. In any or all of the preceding examples, the controller may additionally or optionally include additional instructions for determining a load of the fuel system canister based on each of the amount of desorbed fuel vapors, the amount of refueling vapors, and the amount of breakthrough fuel vapors.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method for an evaporative emissions system in a vehicle, comprising:

routing each of a fuel vapor purge flow from a fuel vapor canister, a loading flow into the fuel vapor canister including refueling vapors, and a breakthrough fuel vapor flow from the fuel vapor canister through a hydrocarbon sensor; and determining a fuel vapor load of the fuel vapor canister based on output from the hydrocarbon sensor during each of the routings.

2. The method of claim 1, wherein the fuel vapor purge flow from the fuel vapor canister is delivered to an intake manifold of an engine of the vehicle, the loading flow into the fuel vapor canister is received from a fuel tank coupled in the vehicle, and the breakthrough fuel vapor flow is directed to atmosphere from the fuel vapor canister.

3. The method of claim 2, wherein the loading flow into the fuel vapor canister from the fuel tank further includes diurnal vapors and running loss vapors.

4. The method of claim 3, wherein the output from the hydrocarbon sensor includes a first amount of fuel vapors in the loading flow, a second amount of fuel vapors in the fuel vapor purge flow, and a third amount of fuel vapors in the breakthrough fuel vapor flow.

5. The method of claim 4, wherein determining the fuel vapor load of the fuel vapor canister based on the output from the hydrocarbon sensor includes subtracting each of the second amount of fuel vapors in the fuel vapor purge flow and the third amount of fuel vapors in the breakthrough fuel vapor flow from the first amount of fuel vapors in the loading flow.

6. The method of claim 2, wherein the vehicle is a hybrid vehicle, and wherein the loading flow into the fuel vapor canister from the fuel tank further includes diurnal vapors.

7. The method of claim 1, further comprising adjusting a three-way valve to route each of the fuel vapor purge flow, the loading flow, and the breakthrough fuel vapor flow through the hydrocarbon sensor.

8. The method of claim 1, further comprising enabling a canister purge operation if the fuel vapor load of the fuel vapor canister is higher than a load threshold.

9. A method, comprising:

adjusting a three-way valve to a first position to flow purge vapors from a canister through a hydrocarbon sensor;

adjusting the three-way valve to a second position to flow refueling vapors from a fuel tank into the canister via the hydrocarbon sensor;

adjusting the three-way valve to a third position to flow breakthrough vapors from the canister into atmosphere via the hydrocarbon sensor; and determining a load of the canister based on output from the hydrocarbon sensor during each adjusting of the three-way valve.

10. The method of claim 9, further comprising initiating a canister purge in response to the load of the canister being higher than a threshold load.

11. The method of claim 9, wherein the hydrocarbon sensor estimates each of an amount of purge vapors desorbed from the canister during a canister purge, an amount of refueling vapors adsorbed into the canister from the fuel tank, and an amount of breakthrough vapors exiting the canister.

12. The method of claim 11, wherein each of the amount of breakthrough vapors and the amount of purge vapors is subtracted from the amount of refueling vapors to determine a change in canister load, and wherein the load of the canister is determined by adding the change in canister load to a previously determined load of the canister.

13. The method of claim 12, wherein the previously determined load of the canister is stored in a memory of a controller.

14. The method of claim 12, wherein the load of the canister is determined in response to each of a purging operation, a refueling operation, and an engine-off mode of operation of a vehicle, the vehicle being a hybrid vehicle.

15. A system for a vehicle, comprising:

an engine;

a fuel system including a fuel tank;

a fuel system canister including a loading port, a purge port, and a vent port;

a canister purge valve;

a vent line coupling the fuel system canister to a fresh air source;

a three-way valve coupled to a hydrocarbon sensor, the three-way valve coupled to each of the loading port, the purge port, and the vent port of the fuel system canister, and the canister purge valve, the vent line, and the fuel tank; and a controller configured with computer readable instructions stored on non-transitory memory for:

in response to a purging operation, adjusting a position of the three-way valve to fluidically couple the hydrocarbon sensor to the purge port of the fuel system canister;

in response to a refueling event, adjusting the position of the three-way valve to fluidically couple the hydrocarbon sensor to the loading port of the fuel system canister; and in response to one of a non-combusting mode of vehicle operation and a vehicle park mode, adjusting the position of the three-way valve to fluidically couple the hydrocarbon sensor to the vent port of the fuel system canister.

16. The system of claim 15, wherein during the purging operation, desorbed fuel vapors flow from the purge port of the fuel system canister via the three-way valve, the hydrocarbon sensor, and the canister purge valve into an intake manifold of the engine, and wherein the hydrocarbon sensor measures an amount of desorbed fuel vapors flowing therethrough.

17. The system of claim 16, wherein during the refueling event, refueling vapors flow from the fuel tank to the loading port of the fuel system canister via the three-way valve and the hydrocarbon sensor, and wherein the hydrocarbon sensor measures an amount of refueling vapors flowing therethrough.

18. The system of claim 17, wherein during one of the non-combusting mode of vehicle operation and vehicle park mode, breakthrough fuel vapors flow from the vent port of the fuel system canister via the three-way valve and the hydrocarbon sensor through the vent line into atmosphere, and wherein the hydrocarbon sensor measures an amount of breakthrough fuel vapors flowing therethrough.

19. The system of claim 18, wherein the controller includes additional instructions for determining a load of the fuel system canister based on each of the amount of desorbed fuel vapors, the amount of refueling vapors, and the amount of breakthrough fuel vapors.

* * * * *